US011814959B2

(12) United States Patent
Donald et al.

(10) Patent No.: US 11,814,959 B2
(45) **Date of Patent: *Nov. 14, 2023**

(54) METHODS FOR INCREASING THE AMPLITUDE OF RECIPROCAL EXTENSIONS AND CONTRACTIONS OF A SHOCK TOOL FOR DRILLING OPERATIONS

(71) Applicant: National Oilwell Varco, L.P., Houston, TX (US)

(72) Inventors: Sean Matthew Donald, Spring, TX (US); Andrew Lawrence Scott, Houston, TX (US); Yong Yang, Spring, TX (US); Roman Kvasnytsia, Edmonton (CA)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/537,743

(22) Filed: Nov. 30, 2021

(65) Prior Publication Data

US 2022/0090449 A1 Mar. 24, 2022

Related U.S. Application Data

(63) Continuation of application No. 15/849,471, filed on Dec. 20, 2017, now Pat. No. 11,220,866.
(Continued)

(51) Int. Cl.
*E21B 7/24* (2006.01)
*E21B 17/07* (2006.01)

(52) U.S. Cl.
CPC ..... *E21B 7/24* (2013.01); *E21B 17/07* (2013.01)

(58) Field of Classification Search
CPC ..... E21B 17/07; E21B 7/24
See application file for complete search history.

(56) References Cited

U.S. PATENT DOCUMENTS 2,991,635 A 7/1961 Warren
3,735,828 A 5/1973 Berryman
(Continued)

FOREIGN PATENT DOCUMENTS

WO 2007113477 A1 10/2007

OTHER PUBLICATIONS

European Office Action dated Aug. 29, 2022, for European Application No. 17829532.5 (5 p.).
(Continued)

*Primary Examiner* — Theodore N Yao
(74) *Attorney, Agent, or Firm* — CONLEY ROSE, P.C.

(57) ABSTRACT

A method for increasing an amplitude of reciprocal axial extensions and contractions of a shock tool configured to induce axial oscillations in a drillstring during drilling operations includes (a) selecting the shock tool. The shock tool has a central axis and an axial length. The shock tool includes an outer housing, a mandrel telescopically disposed within the outer housing, and a first annular piston fixably coupled to the mandrel. The shock tool has a first amplitude of reciprocal axial extension and contraction at a pressure differential between a first fluid pressure in the outer housing and a second fluid pressure outside the outer housing. In addition, the method includes (b) fixably coupling a second annular piston to the mandrel of the shock tool and increasing the axial length of the shock tool after (a). The second annular piston is axially spaced from the first annular piston. The shock tool has a second amplitude of reciprocal axial extension and contraction at the pressure differential between the first fluid pressure in the outer housing and the
(Continued)

second fluid pressure outside the outer housing after (b). The second amplitude of reciprocal axial extension and contraction is greater than the first amplitude of reciprocal axial extension and contraction.

9 Claims, 12 Drawing Sheets

Related U.S. Application Data

(60) Provisional application No. 62/513,760, filed on Jun. 1, 2017, provisional application No. 62/536,955, filed on Dec. 20, 2016.

(56) References Cited

U.S. PATENT DOCUMENTS

| | | | | |
|---|---|---|---|---|
| 3,746,329 | A * | 7/1973 | Galle | E21B 17/07 267/125 |
| 4,186,569 | A | 2/1980 | Aumann | |
| 4,434,863 | A * | 3/1984 | Garrett | E21B 17/07 175/321 |
| 4,830,122 | A | 5/1989 | Walter | |
| 5,133,419 | A | 7/1992 | Barrington | |
| 5,228,516 | A | 7/1993 | Barrington | |
| 5,476,148 | A * | 12/1995 | LaBonte | E21B 17/07 175/322 |
| 11,220,866 | B2 * | 1/2022 | Donald | E21B 7/24 |
| 2002/0050359 | A1 | 5/2002 | Eddison | |
| 2005/0236190 | A1 * | 10/2005 | Walter | E21B 21/106 175/218 |
| 2009/0023502 | A1 | 1/2009 | Koger | |
| 2009/0218100 | A1 | 9/2009 | Williams | |
| 2010/0326730 | A1 | 12/2010 | Prill et al. | |
| 2012/0247832 | A1 * | 10/2012 | Cramer | E21B 7/24 267/140.13 |
| 2013/0168092 | A1 | 7/2013 | Evans | |
| 2015/0034387 | A1 | 2/2015 | Malcolm et al. | |
| 2016/0230479 | A1 | 8/2016 | Khaparde et al. | |

OTHER PUBLICATIONS

Canadian Office Action dated Jun. 10, 2022, for Canadian Application No. 3,047,158 (4 p.).
PCT/US2017/067734 International Search Report and Written Opinion dated Mar. 28, 2018 (16 p.).
Restriction Requirement dated Sep. 5, 2019, for U.S. Appl. No. 15/849,471 (10 p.).
Response to Restriction Requirement dated Sep. 5, 2019, for U.S. Appl. No. 15/849,471; Response filed Nov. 4, 2019 (10 p.).
Office Action dated Nov. 21, 2019, for U.S. Appl. No. 15/849,471 (13 p.).
Response to Office Action dated Nov. 21, 2019, for U.S. Appl. No. 15/849,471; Response filed Apr. 14, 2020 (15 p.).
Final Office Action dated May 8, 2020, for U.S. Appl. No. 15/849,471 (13 p.).
Response to Final Office Action dated May 8, 2020, for U.S. Appl. No. 15/849,471; Response filed Jul. 8, 2020 (13 p.).
Final Office Action dated Jul. 22, 2020, for U.S. Appl. No. 15/849,471 (14 p.).
Response to Final Office Action dated Jul. 22, 2020, for U.S. Appl. No. 15/849,471; Response filed Sep. 22, 2020 (15 p.).
Advisory Action dated Oct. 9, 2020, for U.S. Appl. No. 15/849,471 (2 p.).
RCE and Response to Final Office Action dated Jul. 22, 2020, for U.S. Appl. No. 15/849,471; Response filed Oct. 22, 2020 (21 p.).
Office Action dated May 11, 2021, for U.S. Appl. No. 15/849,471 (14 p.).
Response to Office Action dated May 11, 2021, for U.S. Appl. No. 15/849,471; Response filed Aug. 11, 2021 (18 p.).
Notice of Allowance dated Sep. 29, 2021, for U.S. Appl. No. 15/849,471 (8 p.).
Australian Examination Report dated Nov. 15, 2022, for Australian Application No. 2017379931 (4 p.).

* cited by examiner

METHODS FOR INCREASING THE AMPLITUDE OF RECIPROCAL EXTENSIONS AND CONTRACTIONS OF A SHOCK TOOL FOR DRILLING OPERATIONS

CROSS-REFERENCE TO RELATED APPLICATIONS

This application is a continuation of U.S. application Ser. No. 15/849,471 filed Dec. 20, 2017, and entitled "Drilling Oscillation Systems and Shock Tools for Same," which claims benefit of U.S. provisional patent application Ser. No. 62/436,955 filed Dec. 20, 2016, and entitled "High Energy Agitator Systems" and benefit of U.S. provisional patent application Ser. No. 62/513,760 filed Jun. 1, 2017, and entitled "Drilling Oscillation Systems and Shock Tools for Same," each of which is hereby incorporated herein by reference in its entirety for all purposes.

STATEMENT REGARDING FEDERALLY SPONSORED RESEARCH OR DEVELOPMENT

Not applicable.

BACKGROUND

The disclosure relates generally to downhole tools. More particularly, the disclosure relates to downhole oscillation systems for inducing axial oscillations in drill strings during drilling operations. Still more particularly, the disclosure relates to shock tools that directly and efficiently convert cyclical pressure pulses in drilling fluid into axial oscillations.

Drilling operations are performed to locate and recover hydrocarbons from subterranean reservoirs. Typically, an earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone.

During drilling, the drillstring may rub against the sidewall of the borehole. Frictional engagement of the drillstring and the surrounding formation can reduce the rate of penetration (ROP) of the drill bit, increase the necessary weight-on-bit (WOB), and lead to stick slip. Accordingly, various downhole tools that induce vibration and/or axial reciprocation may be included in the drillstring to reduce friction between the drillstring and the surrounding formation. One such tool is an oscillation system, which typically includes an pressure pulse generator and a shock tool. The pressure pulse generator produces pressure pulses in the drilling fluid flowing therethrough and the shock tool converts the pressure pulses in the drilling fluid into axial reciprocation. The pressure pulses created by the pressure pulse generator are cyclic in nature. The continuous stream of pressure peaks and troughs in the drilling fluid cause the shock tool to cyclically extend and retract telescopically at the pressure peak and pressure trough, respectively. A spring is usually used to induce the axial retraction during the pressure trough.

BRIEF SUMMARY OF THE DISCLOSURE

Embodiments of methods for increasing an amplitude of reciprocal axial extensions and contractions of a shock tool are disclosed herein. In one embodiment, a method for increasing an amplitude of reciprocal axial extensions and contractions of a shock tool comprises (a) selecting the shock tool. The shock tool has a central axis and an axial length. The shock tool includes an outer housing, a mandrel assembly telescopically disposed within the outer housing, and a first annular piston fixably coupled to the mandrel assembly. The shock tool has a first amplitude of reciprocal axial extension and contraction at a pressure differential between a first fluid pressure in the mandrel assembly and a second fluid pressure outside the outer housing. In addition, the method comprises (b) fixably coupling a second annular piston to the mandrel assembly of the shock tool and increasing the axial length of the shock tool after (a). The second annular piston is axially spaced from the first annular piston. The shock tool has a second amplitude of reciprocal axial extension and contraction at the pressure differential between the first fluid pressure in the mandrel assembly and the second fluid pressure outside the outer housing after (b). The second amplitude of reciprocal axial extension and contraction is greater than the first amplitude of reciprocal axial extension and contraction.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
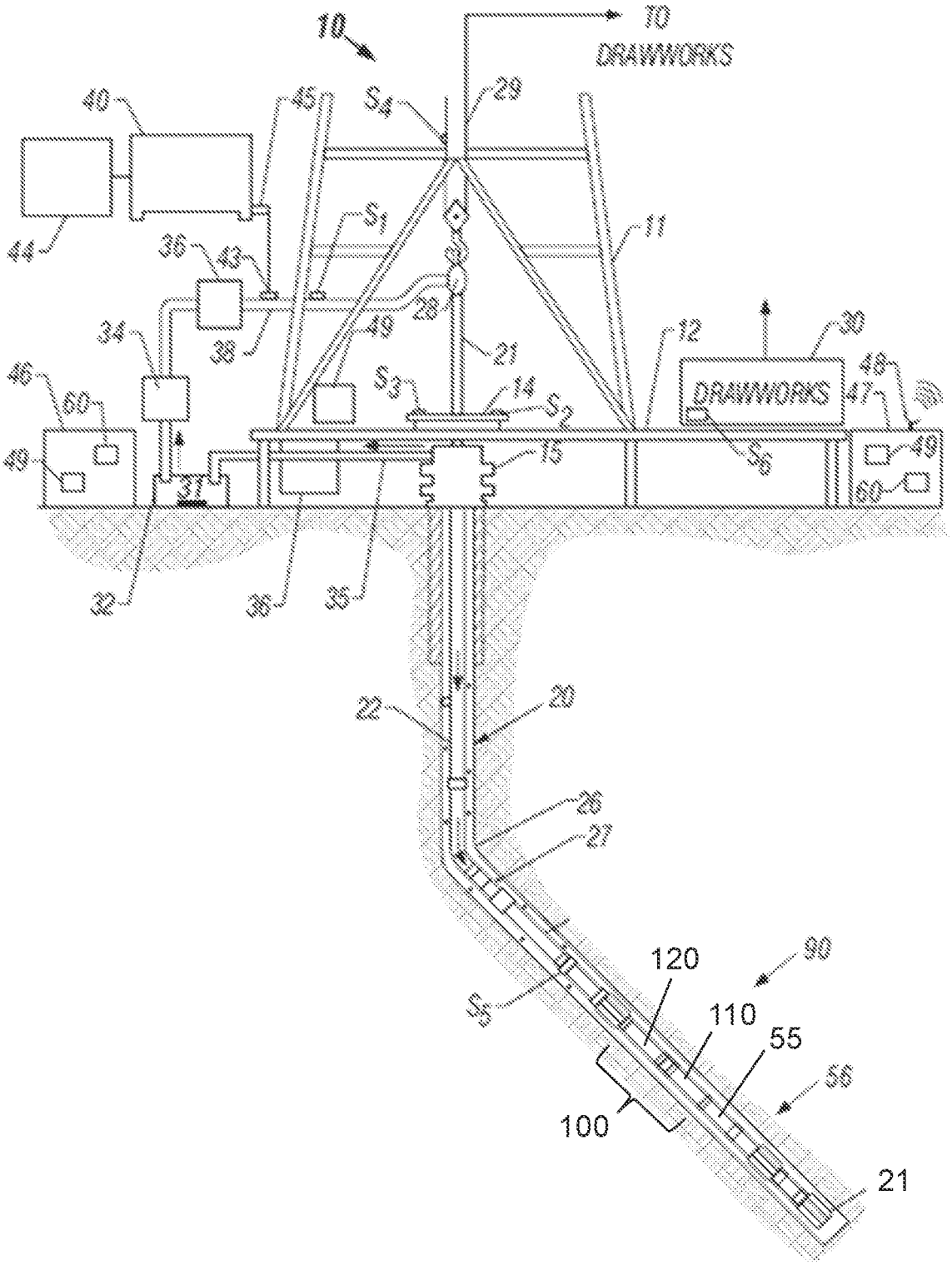
FIG. 1 is a schematic view of a drilling system including an embodiment of an oscillation system in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

Referring now to FIG. 1, a schematic view of an embodiment of a drilling system 10 is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). In other embodiments, the rotary table (e.g., rotary table 14) may be augmented or replaced by a top drive suspended in the derrick (e.g., derrick 11) and connected to the drillstring (e.g., drillstring 20).

Drilling assembly 90 includes a drillstring 20 and a drill bit 21 coupled to the lower end of drillstring 20. Drillstring 20 is made of a plurality of pipe joints 22 connected end-to-end, and extends downward from the rotary table 14 through a pressure control device 15, such as a blowout preventer (BOP), into the borehole 26. Drill bit 21 is rotated with weight-on-bit (WOB) applied to drill the borehole 26 through the earthen formation. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 21 through the formation. In addition, drill bit 21 can be rotated from the surface by drillstring 20 via rotary table 14 and/or a top drive, rotated by downhole mud motor 55 disposed along drillstring 20 proximal bit 21, or combinations thereof (e.g., rotated by both rotary table 14 via drillstring 20 and mud motor 55, rotated by a top drive and the mud motor 55, etc.). For example, rotation via downhole motor 55 may be employed to supplement the rotational power of rotary table 14, if required, and/or to effect changes in the drilling process. In either case, the rate-of-penetration (ROP) of the drill bit 21 into the borehole 26 for a given formation and a drilling assembly largely depends upon the WOB and the rotational speed of bit 21.

During drilling operations a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through mud motor 55 and is discharged at the borehole bottom through nozzles in face of drill bit 21, circulates to the surface through an annulus 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

While drilling, one or more portions of drillstring 20 may contact and slide along the sidewall of borehole 26. To reduce friction between drillstring 20 and the sidewall of borehole 26, in this embodiment, an oscillation system 100 is provided along drillstring 20 proximal motor 55 and bit 21. Oscillation system 100 includes a pressure pulse generator 110 coupled to motor 55 and a shock tool 120 coupled to pulse generator 110. Pulse generator 110 generates cyclical pressure pulses in the drilling fluid flowing down drillstring 20 and shock tool 120 cyclically and axially extends and retracts as will be described in more detail below. With bit 21 disposed on the hole bottom, the axial extension and retraction of shock tool 120 induces axial reciprocation in the portion of drillstring above oscillation system 100, which reduces friction between drillstring 20 and the sidewall of borehole.

In general, pulse generator 110 and mud motor 55 can be any pressure pulse generator and mud motor, respectively, known in the art. For example, as is known in the art, pulse generator 110 can be a valve operated to cyclically open and close as a rotor of mud motor 55 rotates within a stator of mud motor 55. When the valve opens, the pressure of the drilling mud upstream of pulse generator 110 decreases, and when the valve closes, the pressure of the drilling mud upstream of pulse generator 110 increases. Examples of such valves are disclosed in U.S. Pat. Nos. 6,279,670, 6,508,317, 6,439,318, and 6,431,294, each of which is incorporated herein by reference in its entirety for all purposes.

Figure 2:
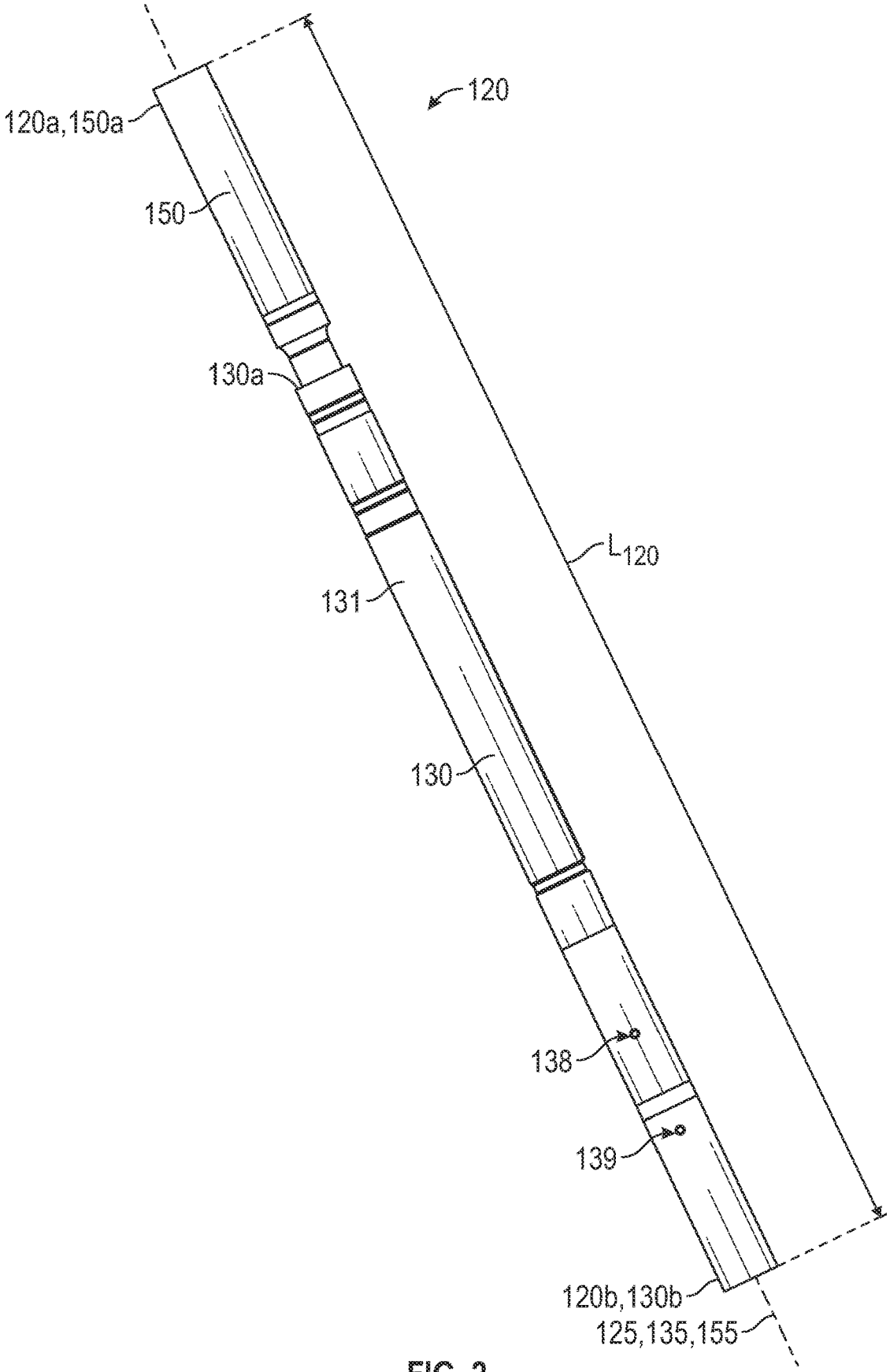
FIG. 2 is a side view of the shock tool of the oscillation system of FIG. 1.
Figure 3:
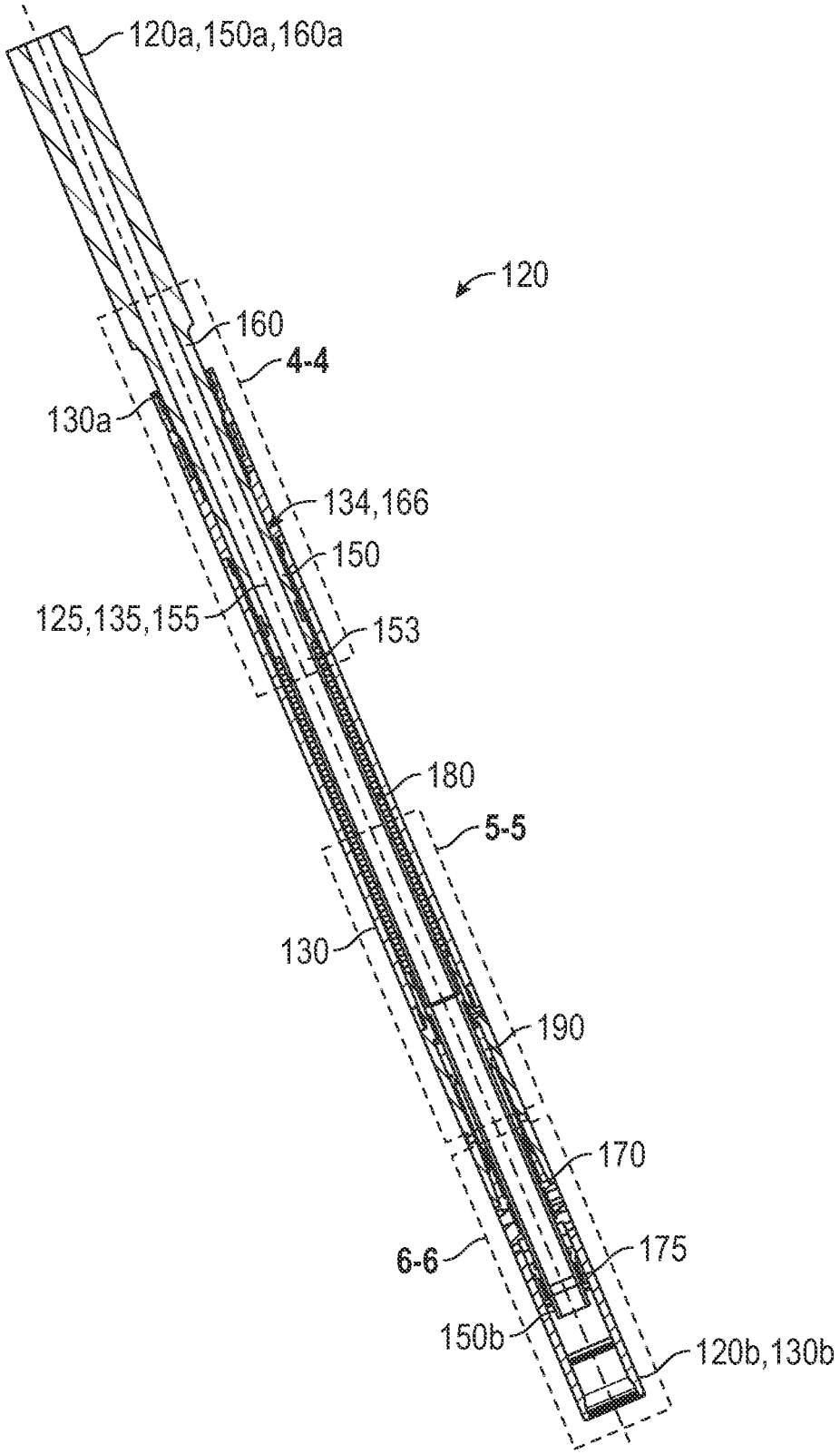
FIG. 3 is a cross-sectional side view of the shock tool of FIG. 2.

Referring now to FIGS. 2 and 3, shock tool 120 of oscillation system 100 is shown. Shock tool 120 has a first or uphole end 120*a*, a second or downhole end 120*b* opposite end 120*a*, and a central or longitudinal axis 125. As shown in FIG. 1, uphole end 120*a* is coupled to the portion of drillstring 20 disposed above oscillation system 100 and downhole end 120*b* is coupled to pulse generator 110. Tool 120 has a length $L_{120}$ measured axially from end 120*a* to end 120*b*. As will be described in more detail below, shock tool 120 cyclically axially extends and retracts in response to the pressure pulses in the drilling fluid generated by pulse generator 110 during drilling operations. During extension of tool 120, ends 120*a*, 120*b* move axially away from each other and length $L_{120}$ increases, and during contraction of tool 120, ends 120*a*, 120*b* move axially toward each other and length $L_{120}$ decreases. Thus, shock tool 120 may be described as having an "extended" position with ends 120*a*, 120*b* axially spaced apart to the greatest extent (i.e., when length $L_{120}$ is at a maximum) and a retracted position with ends 120*a*, 120*b* axially spaced apart to the smallest extent (i.e., when length $L_{120}$ is at a minimum).

Referring still to FIGS. 2 and 3, in this embodiment, shock tool 120 includes an outer housing 130, a mandrel assembly 150 telescopically disposed within outer housing 130, a biasing member 180 disposed about mandrel assembly 150 within outer housing 130, and an annular floating piston 190 disposed about mandrel assembly 150 within outer housing 130. Thus, biasing member 180 and floating piston 190 are radially positioned between mandrel assembly 150 and outer housing 130. Mandrel assembly 150 and outer housing 130 are tubular members, each having a central or longitudinal axis 155, 135, respectively, coaxially aligned with axis 125 of shock tool 120. Mandrel assembly 150 can move axially relative to outer housing 130 to enable the cyclical axial extension and retraction of shock tool 120. Biasing member 180 axially biases mandrel assembly 150 and shock tool 120 to a "neutral" position between the extended position and the retracted position. As will be described in more detail below, floating piston 190 is free to move axially along mandrel assembly 150 and defines a barrier to isolate biasing member 180 from drilling fluids.

Referring now to FIGS. 4-7, outer housing 130 has a first or uphole end 130*a*, a second or downhole end 130*b* opposite end 130*a*, a radially outer surface 131 extending axially between ends 130*a*, 130*b*, and a radially inner surface 132 extending axially between ends 130*a*, 130*b*. Uphole end 130*a* is axially positioned below uphole end 120*a* of shock tool 120. However, downhole end 130*b* is coincident with, and hence defines downhole end 120*b* of shock tool 120.

Inner surface 132 defines a central throughbore or passage 133 extending axially through housing 130 (i.e., from uphole end 130*a* to downhole end 130*b*). Outer surface 131 is disposed at a radius that is uniform or constant moving axially between ends 130*a*, 130*b*. Thus, outer surface 131 is generally cylindrical between ends 130*a*, 130*b*. Inner surface 132 is disposed at a radius that varies moving axially between ends 130*a*, 130*b*.

In this embodiment, outer housing 130 is formed with a plurality of tubular members connected end-to-end with mating threaded connections (e.g., box and pin connections). Some of the tubular members forming outer housing 130 define annular shoulders along inner surface 132. In particular, moving axially from uphole end 130*a* to downhole end 130*b*, inner surface 132 includes a frustoconical uphole facing annular shoulder 132*a*, an uphole facing annular shoulder 132*b*, a downward facing planar annular shoulder 132*c*, an uphole facing planar annular shoulder 132*d*, and a downward facing planar annular shoulder 132*e*. In addition, inner surface 132 includes a plurality of circumferentially-spaced parallel internal splines 134 axially positioned between shoulders 132*a*, 132*b*. As will be described in more detail below, splines 134 slidingly engage mating external splines on mandrel assembly 150, thereby allowing mandrel assembly 150 to move axially relative to outer housing 130 but preventing mandrel assembly 150 from rotating about axis 125 relative to outer housing 130. Each spline 134 extends axially between a first or uphole end 134*a* and a second or downhole end 134*b*. The uphole ends 134*a* of splines 134 define a plurality of circumferentially-spaced uphole facing frustoconical shoulders 134*c* extending radially into passage 133, and the downhole ends 134*b* of splines 134 define a plurality of circumferentially-spaced downhole facing planar shoulders 134*d* extending radially into passage 133.

Referring still to FIGS. 4-7, inner surface 132 also includes a cylindrical surface 136*a* extending axially from end 130*a* to shoulder 132*a*, a cylindrical surface 136*b* extending axially between shoulders 132*a*, 134*c*, a cylindrical surface 136*c* extending axially between shoulders 134*d*, 132*b*, a cylindrical surface 136*d* extending axially between shoulders 132*b*, 132*c*, a cylindrical surface 136*e* extending axially between shoulders 132*c*, 132*d*, a cylindrical surface 136*f* axially positioned between shoulders 132*d*, 132*e*, and a cylindrical surface 136*g* extending axially from shoulder 132*e*.

Figure 4:
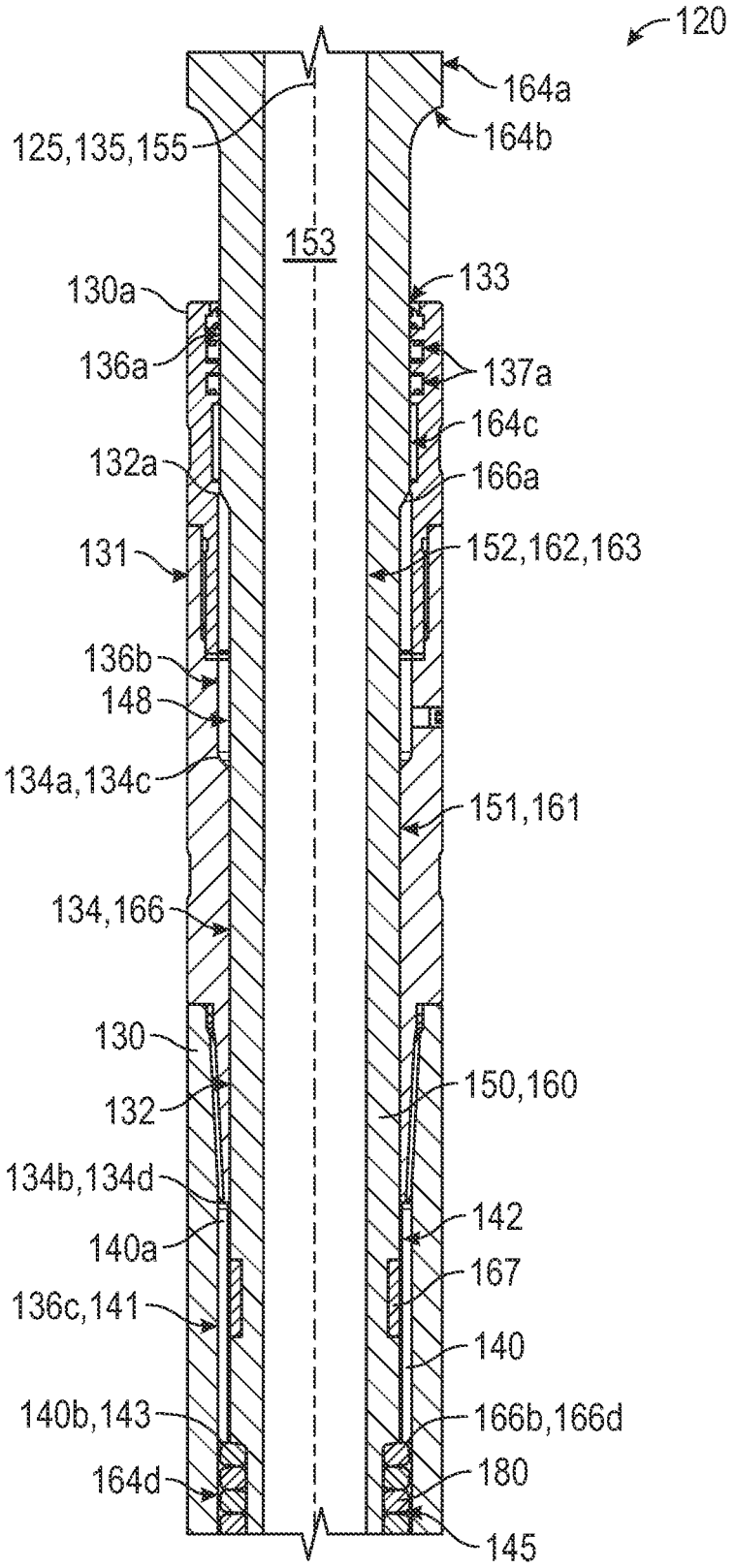
FIG. 4 is an enlarged partial cross-sectional side view of the shock tool of FIG. 2 taken in section 4-4 FIG. 3.
Figure 5:
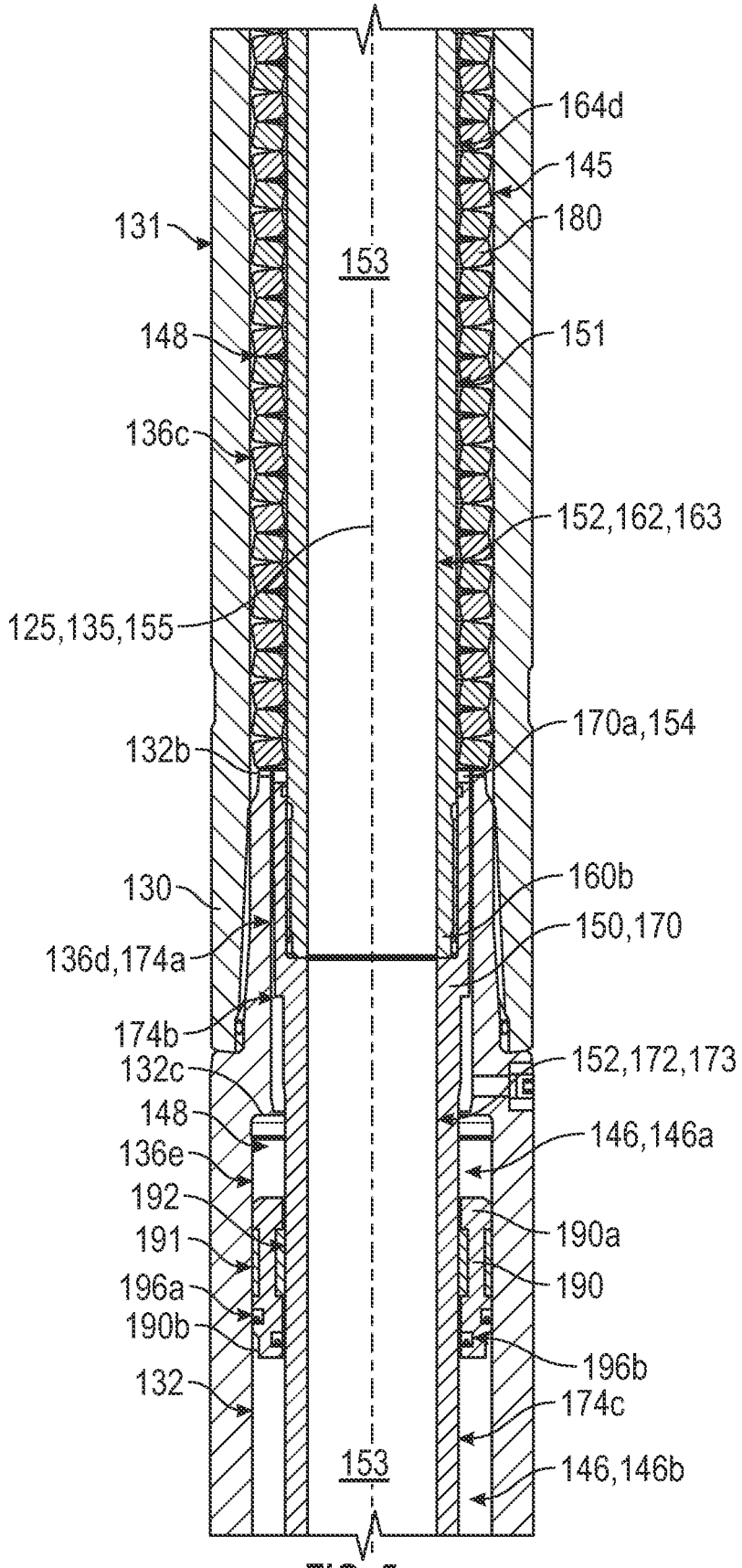
FIG. 5 is an enlarged partial cross-sectional side view of the shock tool of FIG. 2 taken in section 5-5 FIG. 3.
Figure 6:
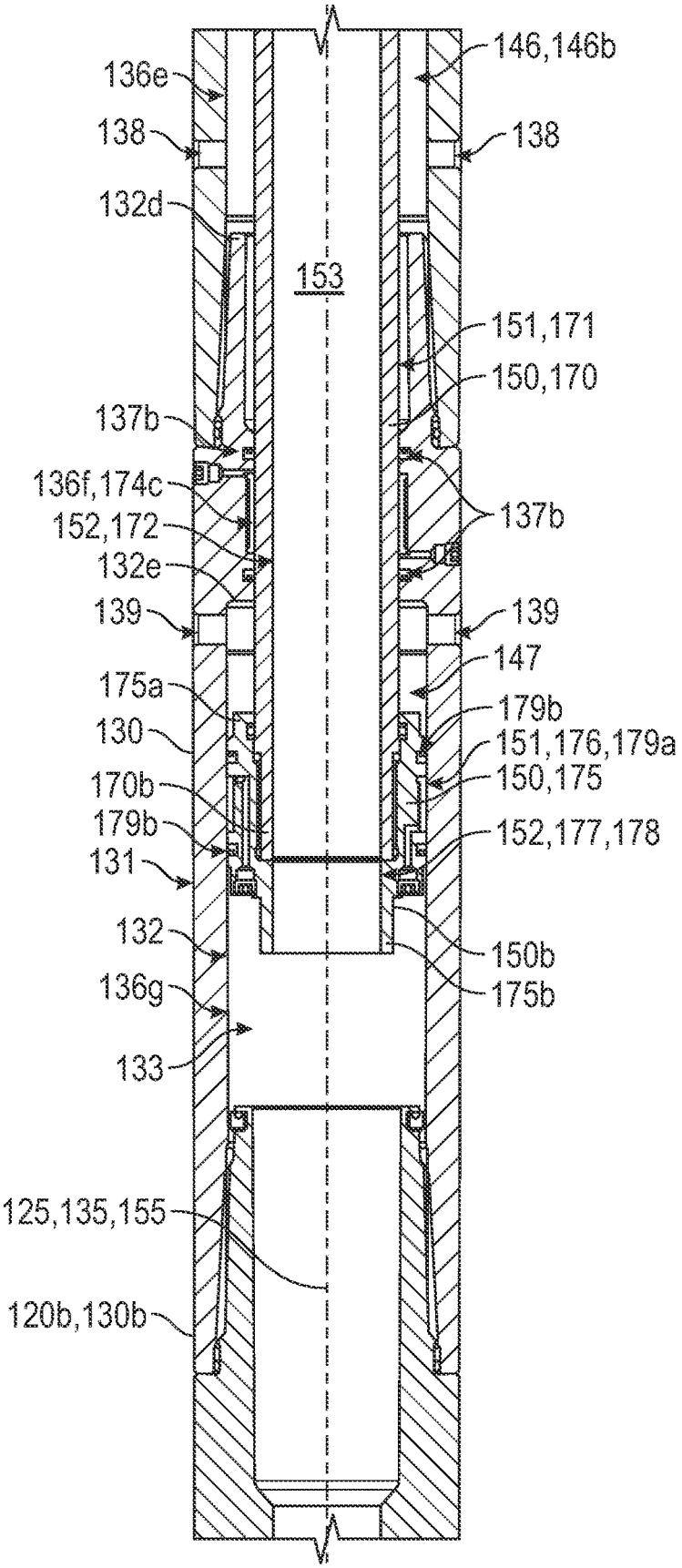
FIG. 6 is an enlarged partial cross-sectional side view of the shock tool of FIG. 2 taken in section 6-6 FIG. 3.
Figure 7:
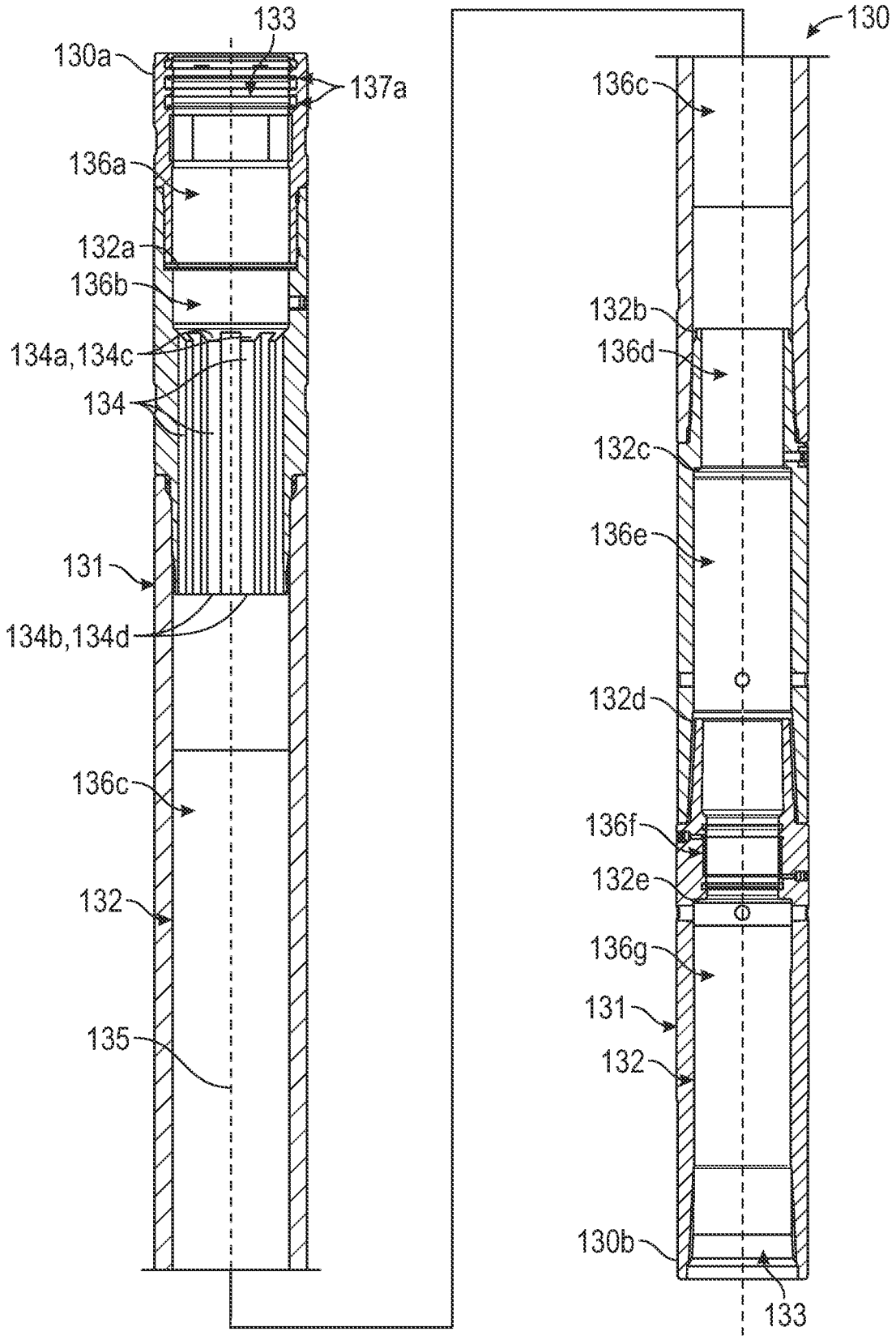
FIG. 7 is a cross-sectional side view of the outer housing of the shock tool of FIG. 3.

Along each cylindrical surface 136*a*, 136*b*, 136*c*, 136*d*, 136*e*, 136*f*, 136*g* the radius of inner surface 132 is constant and uniform, however, since shoulders 132*a*, 132*b*, 132*c*, 132*d*, 132*e*, 134*c*, 134*d* extend radially, the radius of inner surface 132 along different cylindrical surfaces 136*a*, 136*b*, 136*c*, 136*d*, 136*e*, 136*f*, 136*g* may vary. As best shown in FIGS. 4-6, and as will be described in more detail below, cylindrical surfaces 136*a*, 136*d*, 136*f*, 136*g* slidingly engage mandrel assembly 150, whereas cylindrical surfaces 136*b*, 136*c*, 136*e* are radially spaced from mandrel assembly 150.

In this embodiment, a plurality of axially spaced annular seal assemblies 137*a* are disposed along cylindrical surface 136*a* and radially positioned between mandrel assembly 150 and outer housing 130. Seal assemblies 137*a* form annular seals between mandrel assembly 150 and outer housing 130, thereby preventing fluids from flowing axially between cylindrical surface 136*a* and mandrel assembly 150. Thus, seal assemblies 137*a* prevent fluids from inside housing 130 from flowing upwardly between mandrel assembly 150 and end 130*a* into annulus 27 during drilling operations, and prevent fluids in annulus 27 from flowing between mandrel assembly 150 and end 130*a* into housing 130. In addition, in this embodiment, a plurality of axially spaced annular seal assemblies 137*b* are disposed along cylindrical surface 136*f* and radially positioned between outer housing 130 and mandrel assembly 150. Seal assemblies 137*b* form annular seals between mandrel assembly 150 and outer housing 130, thereby preventing fluids from flowing axially between cylindrical surface 136*f* and mandrel assembly 150.

As best shown in FIGS. 2 and 6, outer housing 130 includes a first plurality of circumferentially-spaced ports 138 extending radially from outer surface 131 to inner surface 132, and a second plurality of circumferentially-spaced ports 139 extending radially from outer surface 131 to inner surface 132. In particular, ports 138 extend radially from outer surface 131 to cylindrical surface 136*e*, and ports 139 extend radially from outer surface 131 to cylindrical surface 136*g*. Ports 138 are disposed at the same axial position along outer housing 130 and are uniformly angularly spaced about axis 135. Similarly, ports 139 are disposed at the same axial position along outer housing 130 and are uniformly angularly spaced about axis 135. However, ports 138 are axially spaced above ports 139. As will be described in more detail below, ports 138, 139 allow fluid communication between the annulus 27 outside shock tool 120 and through passage 133 of outer housing 130.

Referring now to FIGS. 4-6 and 8, mandrel assembly 150 has a first or uphole end 150*a*, a second or downhole end 150*b* opposite end 150*a*, a radially outer surface 151 extending axially between ends 150*a*, 150*b*, and a radially inner surface 152 extending axially between ends 150*a*, 150*b*. Uphole end 150*a* is coincident with, and hence defines uphole end 120*a* of shock tool 120. In addition, uphole end 150*a* is axially positioned above uphole end 130*a* of outer housing 130. Downhole end 150*b* is disposed without outer housing 130 and axially positioned above downhole end 130*b*. Inner surface 152 defines a central throughbore or passage 153 extending axially through mandrel assembly 150 (i.e., from uphole end 150*a* to downhole end 150*b*). Inner surface 152 is disposed at a radius that is uniform or constant moving axially between ends 150*a*, 150*b*. Thus, inner surface 152 is generally cylindrical between ends 150*a*, 150*b*. Outer surface 151 is disposed at a radius that varies moving axially between ends 150*a*, 150*b*.

In this embodiment, mandrel assembly 150 includes a mandrel 160, a tubular member or washpipe 170 coupled to mandrel 160, and an annular static piston 175 coupled to washpipe 170. Mandrel 160, washpipe 170, and piston 175 are connected end-to-end and are coaxially aligned with axis 155.

Referring still to FIGS. 4-6 and 8, mandrel 160 has a first or uphole end 160*a*, a second or downhole end 160*b* opposite end 160*a*, a radially outer surface 161 extending axially between ends 160*a*, 160*b*, and a radially inner surface 162 extending axially between ends 160*a*, 160*b*. Uphole end 160*a* is coincident with, and hence defines uphole end 150*a* of mandrel assembly 150. Inner surface 162 is a cylindrical surface defining a central throughbore or passage 163 extending axially through mandrel 160. Inner surface 162 and passage 163 define a portion of inner surface 152 and passage 153 of mandrel assembly 150.

Moving axially from uphole end 160*a*, outer surface 161 includes a cylindrical surface 164*a*, extending from end 160*a*, a concave downhole facing annular shoulder 164*b*, a cylindrical surface 164*c* extending from shoulder 164*b*, a plurality circumferentially-spaced parallel external splines 166, and a cylindrical surface 164*d* axially positioned between splines 166 and downhole end 160*b*. A portion of outer surface 161 extending from downhole end 160*b* includes external threads that threadably engage mating internal threads of washpipe 170.

Splines 166 are axially positioned between cylindrical surfaces 164*c*, 164*d*. Each spline 166 extends axially between a first or uphole end 166*a* and a second or downhole end 166*b*. In this embodiment, each spline 166 includes two segments separated by a cylindrical surface that receives a lock ring 167, which functions as a shouldering mechanism to limit the upward travel of mandrel 160 relative to housing 130. In particular, as best shown in FIG. 4, mandrel 160 can move axially upward relative to housing 130 until lock ring 167 axially engages shoulders 134*d* at lower ends 134*b* of splines 134, thereby preventing further axial upward movement of mandrel 160 relative to housing 130. Limiting the upward travel of the mandrel 160 relative to housing 130 reduces the likelihood of overstressing biasing member 180. In this embodiment, the upward travel of mandrel 160 relative to housing 130 is limited to about 1.0 in.

Referring again to FIGS. 4-6 and 8, the downhole ends 166*b* of splines 166 define a plurality of circumferentially-spaced downhole facing planar shoulders 166*d*. Splines 166 of mandrel 160 slidingly engage mating splines 134 of outer housing 130, thereby allowing mandrel assembly 150 to move axially relative to outer housing 130 but preventing mandrel assembly 150 from rotating about axis 125 relative to outer housing 130. Thus, engagement of mating splines 134, 166 enables the transfer of rotation torque between mandrel assembly 150 and outer housing 130 during drilling operations.

Washpipe 170 has a first or uphole end 170*a*, a second or downhole end 170*b* opposite end 170*a*, a radially outer surface 171 extending axially between ends 170*a*, 170*b*, and a radially inner surface 172 extending axially between ends 170*a*, 170*b*. Inner surface 172 is a cylindrical surface defining a central throughbore or passage 173 extending axially through washpipe 170. Inner surface 172 and passage 173 define a portion of inner surface 152 and passage 153 of mandrel assembly 150. A portion of inner surface 172 extending axially from uphole end 170*a* includes internal threads that threadably engage the mating external threads provided at downhole end 160*b* of mandrel 160, thereby fixably securing mandrel 160 and washpipe 170 end-to-end. With end 160*b* of mandrel 160 threaded into uphole end 170*a* of washpipe 170, end 170*a* defines an annular uphole facing planar shoulder 154 along outer surface 151.

Moving axially from uphole end 170*a*, outer surface 171 includes a cylindrical surface 174*a* extending from end 170*a*, a downhole facing planar annular shoulder 174*b*, and a cylindrical surface 174*c* extending from shoulder 174*b*. A portion of outer surface 171 at downhole end 170*b* includes external threads that threadably engage mating internal threads of piston 175.

Figure 8:
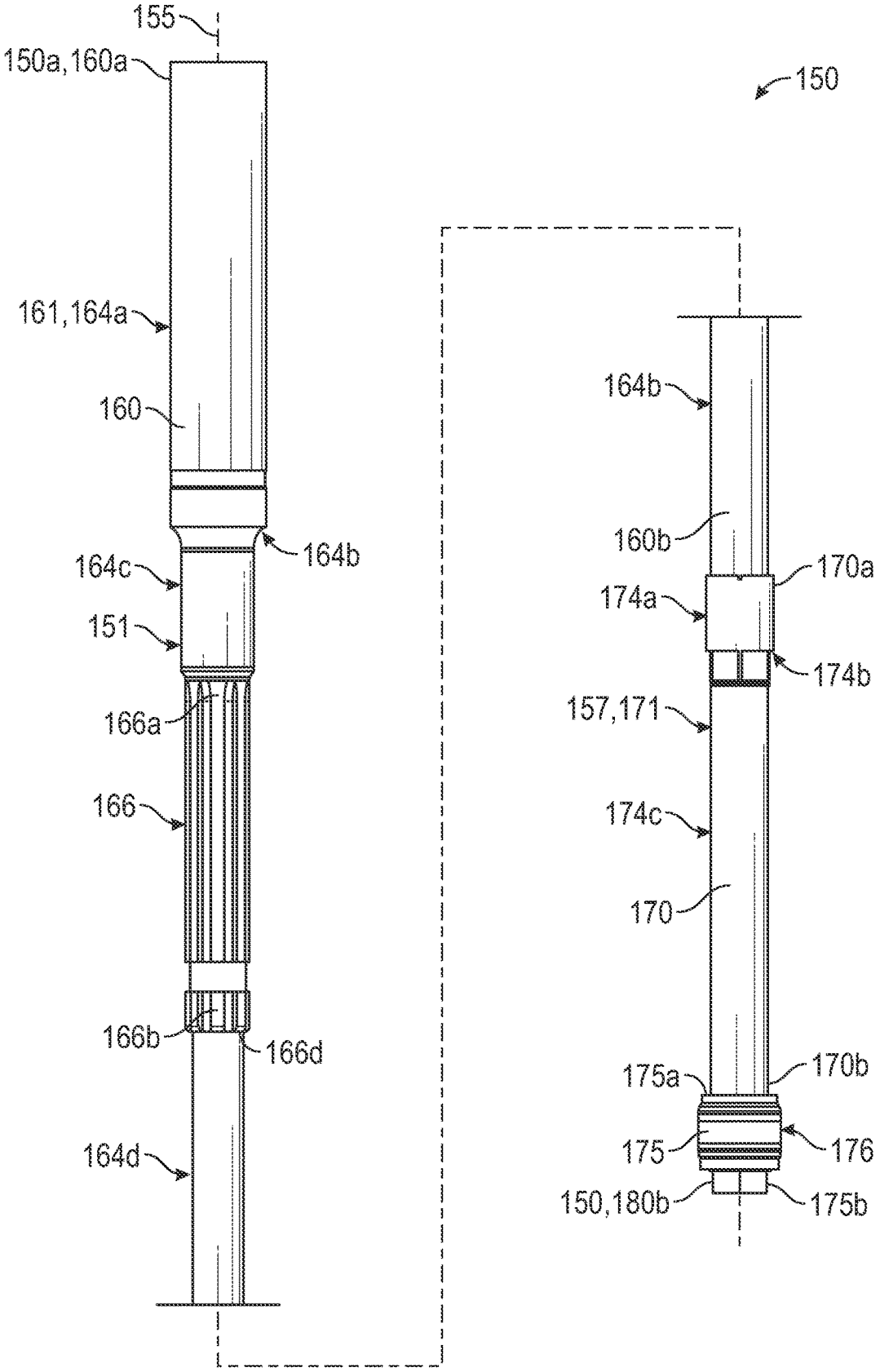
FIG. 8 is a side view of the mandrel assembly of the shock tool of FIG. 3.

As best shown in FIGS. 6 and 8, annular piston 175 is disposed about downhole end 170*b* of washpipe 170 and extends axially therefrom. Piston 175 has a first or uphole end 175*a*, a second or downhole end 175*b* opposite end 175*a*, a radially outer surface 176 extending axially between ends 175*a*, 175*b*, and a radially inner surface 177 extending axially between ends 175*a*, 175*b*. Inner surface 177 defines a central throughbore or passage 178 extending axially through piston 175. Inner surface 177 and passage 178 define a portion of inner surface 152 and passage 153 of mandrel assembly 150. A portion of inner surface 177 extending axially from upper end 175*a* includes internal threads that threadably engage the mating external threads provided at downhole end 170*b* of washpipe 170, thereby fixably securing annular piston 175 to downhole end 170*b* of washpipe 170.

Outer surface 176 includes a cylindrical surface 179*a*. A plurality of axially spaced annular seal assemblies 179*b* are disposed along cylindrical surface 179*a* and radially positioned between piston 175 and outer housing 130. Seal assemblies 179*b* form annular seals between piston 175 and outer housing 130, thereby preventing fluids from flowing axially between cylindrical surfaces 136*g*, 179*a* of outer housing 130 and piston 175, respectively. As will be described in more detail below, seal assemblies 179*b* maintain separation of relatively low pressure drilling fluid in fluid communication with annulus 27 via ports 139 and relatively high pressure drilling fluid flowing down drillstring 20 and through mandrel assembly 150.

Referring now to FIGS. 4-6, mandrel assembly 150 is disposed within outer housing 130 with mating splines 134, 166 intermeshed and uphole ends 150*a*, 160*a* positioned above end 130*a* of housing 130. In addition, cylindrical surfaces 136*a*, 164*c* slidingly engage with annular seal assemblies 137*a* sealingly engaging surface 164*c* of mandrel 160; cylindrical surfaces 136*f*, 174*c* slidingly engage with annular seal assemblies 137*b* sealingly engaging surface 174*c* of washpipe 170; and cylindrical surfaces 136*g*, 179*a* slidingly engage with annular seal assemblies 179*b* sealingly engaging surface 136*g* of outer housing 130.

Cylindrical surfaces 136*d*, 174*a* are radially adjacent one another, however, seals are not provided between surfaces 136*d*, 174*a*. Thus, although surfaces 136*d*, 174*a* may slidingly engage, fluid can flow therebetween. Although annular seal assemblies 179*b* are provided between surfaces 136*f*, 174*c* in this embodiment, in other embodiments, seals are not provided between surfaces 136*f*, 174*c*, and thus, fluids can flow therebetween.

Cylindrical surface 136*c* of outer housing 130 is radially opposed to the lower portions of external splines 166 of mandrel 160 but radially spaced therefrom. An annular sleeve 140 is positioned about the lower portions of external splines 166 and axially abuts shoulders 134*d* defined by the downhole ends 134*b* of internal splines 134. In particular, sleeve 140 has a first or uphole end 140*a* engaging shoulders 134*d*, a second or downhole end 140*b* proximal shoulders 166*d* defined by the downhole ends 166*b* of external splines 160, a radially outer cylindrical surface 141 slidingly engaging cylindrical surface 136*c*, and a radially inner cylindrical surface 142 slidingly engaging splines 166. As will be described in more detail below, downhole end 140*b* defines an annular downhole facing planar shoulder 143 within housing 130.

Referring still to FIGS. 4-6, cylindrical surfaces 136*c*, 164*d* of outer housing 130 and mandrel 160, respectively, are radially opposed and radially spaced apart; cylindrical surfaces 136*e*, 174*c* of outer housing 130 and washpipe 170, respectively, are radially opposed and radially spaced apart; and cylindrical surfaces 136*g*, 174*d* of outer housing 130 and washpipe 170, respectively, are radially opposed and radially spaced apart. As a result, shock tool 120 includes a first annular space or annulus 145, a second annular space or annulus 146 axially positioned below annulus 145, and a third annular space or annulus 147 axially positioned below annulus 146. Annulus 145 is radially positioned between surfaces 136*c*, 164*d* and extends axially from the axially lower of shoulder 143 of sleeve 140 and shoulders 166*d* of splines 166 to the axially upper of shoulder 132*b* of housing 130 and shoulder 154 of mandrel assembly 150 (depending on the relatively axial positions of mandrel assembly 150 and outer housing 130). Annulus 146 is radially position between surfaces 136*e*, 174*c* and extends axially from shoulder 132*c* of housing 130 to shoulder 132*d* of housing 130. Annulus 147 is radially positioned between surfaces 136*g*, 174*d* and extends axially from shoulder 132*e* of housing 130 to uphole end 175*a* of piston 175. Ports 139 extend radially from annulus 147, and thus, provide fluid communication between annulus 147 and annulus 27.

Referring now to FIGS. 4 and 5, biasing member 180 is disposed about mandrel assembly 150 and positioned in annulus 145. Biasing member 180 has a first or uphole end 180*a* proximal shoulders 143, 166*d* and a second or downhole end 180*b* proximal shoulder 132*b*, 154. Biasing member 180 has a central axis coaxially aligned with axes 125, 135, 155. In this embodiment, biasing member 180 is a stack of Belleville springs.

Biasing member 180 is axially compressed within annulus 145 with its uphole end 180*a* axially bearing against the lowermost of shoulder 143 of sleeve 140 and shoulders 166*d* of splines 166, and its downhole end 180*b* axially bearing against the uppermost of shoulder 132*b* of housing 130 and shoulder 154 defined by upper end 170*a* of washpipe 170. More specifically, during the cyclical axial extension and retraction of shock tool 120, mandrel assembly 150 moves axially uphole and downhole relative to outer housing 130. As mandrel assembly 150 moves axially uphole relative to outer housing 130, biasing member 180 is axially compressed between shoulders 154, 143 as shoulder 154 lifts end 180*b* off shoulder 132*b* and shoulders 166*d* moves axially upward and away from shoulder 143 and end 180*a*. As a result, the axial length of biasing member 180 measured axially between ends 180*a*, 180*b* decreases and biasing member 180 exerts an axial force urging shoulders 154, 143 axially apart (i.e., urges shoulder 154 axially downward toward shoulder 132*b* and urges shoulder 143 axially upward toward shoulders 166*d*). As mandrel assembly 150 moves axially downhole relative to outer housing 130, biasing member 180 is axially compressed between shoulders 166*d*, 132*b* as shoulders 166*d* push end 180*a* downward and shoulder 154 moves axially downward and away from shoulder 132*b* and end 180*b*. As a result, the axial length of biasing member 180 measured axially between ends 180*a*, 180*b* decreases and biasing member 180 exerts an axial force urging shoulders 166*d*, 132*b* axially apart (i.e., urges shoulders 166*d* axially upward toward shoulder 143 and urges shoulder 132*b* axially downward toward shoulder 154). Thus, when shock tool 120 axially extends or contracts, biasing member 180 biases shock tool 120 and mandrel assembly 150 to a "neutral" position with shoulders 132*b*, 154 disposed at the same axial position engaging end 180*b* of biasing member 180, and shoulders 143, 166*d* disposed at the same axial position engaging end 180*a* of biasing member 180. In this embodiment, biasing member 180 is preloaded (i.e., in compression) with tool 120 in the neutral positon such that biasing member 180 provides a restoring force urging tool 120 to the neutral position upon any axial extension or retraction of tool 120 (i.e., upon any relative axial movement between mandrel assembly 150 and outer housing 130).

Referring now to FIG. 5, annular piston 190 is disposed about mandrel assembly 150 and positioned in annulus 146. Accordingly, piston 190 divides annulus 146 into a first or uphole section 146*a* extending axially from shoulder 132*c* to piston 190 and a second or downhole section 146*b* extending axially from piston 190 to shoulder 132*d*. Piston 190 has a first or uphole end 190*a*, a second or downhole end 190*b* opposite end 190*a*, a radially outer surface 191 extending axially between ends 190*a*, 190*b*, and a radially inner surface 192 extending axially between ends 190*a*, 190*b*. Piston 190 has a central axis coaxially aligned with axes 125, 135, 155.

Inner surface 192 is a cylindrical surface defining a central throughbore or passage 193 extending axially through piston 190. Washpipe 170 extends though passage 193 with cylindrical surfaces 174*c*, 192 slidingly engaging. Outer surface 191 is a cylindrical surface that slidingly engages cylindrical surface 136*e* of outer housing 130.

An annular seal assembly 196*a* is disposed along outer cylindrical surface 191 and radially positioned between piston 190 and outer housing 130, and an annular seal assembly 196*b* is disposed along inner cylindrical surface 192 and radially positioned between piston 190 and washpipe 170. Seal assembly 196*a* forms an annular seal between piston 190 and outer housing 130, thereby preventing fluids from flowing axially between cylindrical surfaces 191, 136*e*. Seal assembly 196*b* forms an annular seal between piston 190 and mandrel assembly 150, thereby preventing fluids from flossing axially between cylindrical surfaces 174*c*, 192.

Referring again to FIGS. 4 and 5, as previously described, seal assemblies 137*a* seal between mandrel assembly 150 and outer housing 130 at uphole end 130*a*, and seal assemblies 196*a*, 196*b* and piston 190 seal between mandrel assembly 150 and outer housing 130 axially below splines 134, 166 and biasing member 180. To facilitate relatively low friction, smooth relative movement between mandrel assembly 150 and outer housing and to isolate splines 134, 166 and biasing member 180 from drilling fluid, splines 134, 166 and biasing member 180 are bathed in hydraulic oil. In particular, the annuli and passages radially positioned between mandrel assembly 150 and outer housing 130 and extending axially between seal assemblies 137*a* and seal assemblies 196*a*, 196*b* define a hydraulic oil chamber 148 filled with hydraulic oil. Thus, uphole section 146*a* of annulus 146, annulus 145, the passages between annuli 146, 145 (e.g., between cylindrical surfaces 136*d*, 174*a*), and the passages between splines 134, 166 are included in chamber 148, in fluid communication with each other, and are filled with hydraulic oil.

Floating piston 190 is free to move axially within annulus 146 along washpipe 170 in response to pressure differentials between portions 146*a*, 146*b* of annulus 146. Thus, floating piston 190 allows shock tool 120 to accommodate expansion and contraction of the hydraulic oil in chamber 148 due to changes in downhole pressures and temperatures without over pressurizing seal assemblies 137*a*, 196*a*, 196*b*. In this embodiment, hydraulic oil chamber 148 is pressure balanced with the relatively low pressure of drilling fluid in the annulus 27 outside shock tool 120. More specifically, lower portion 146*b* of annulus 146 is in fluid communication with annulus 27 via ports 138, and thus, is at the same pressure as drilling fluid in annulus 27 proximal ports 138. Thus, piston 190 will move axially in annulus 146 until the pressure of the hydraulic oil in chamber 148 is the same as the pressure of the drilling fluid in annulus 27 proximal port 138. As a result, seal assemblies 137*a*, 196*a*, 196*b* do not need to maintain a seal across a pressure differential—seal assemblies 137*a* form seals between hydraulic chamber 148 and annulus 27 proximal end 130*a*, which are at the same pressure (i.e. the pressure of annulus 27), and seal assemblies 196*a*, 196*b* form seals between hydraulic chamber 148 and portion 146*a* of annulus 146, which are at the same pressure (i.e., the pressure of annulus 27).

Referring briefly to FIG. 1, during drilling operations, drilling fluid (or mud) is pumped from the surface down drillstring 20. The drilling fluid flows through oscillation system 100 to bit 21, and then out the face of bit 21 into the open borehole 26. The drilling fluid exiting bit 21 flows back to the surface via the annulus 27 between the drillstring 20 and borehole sidewall. In general, at any given depth in borehole 26, the drilling fluid pumped down the drillstring 20 is at a higher pressure than the drilling fluid in annulus 27, which enables the continuous circulation of drilling fluid. The drilling fluid flowing through mud motor 55 actuates pulse generator 110, which generates cyclical pressure pulses in the drilling fluid. The pressure pulses generated by pulse generator 110 are transmitted through the drilling fluid upstream into shock tool 120.

Referring now to FIG. 6, downhole end 175*b* of piston 175 faces and directly contacts drilling fluid flowing through passage 153 of mandrel assembly 150, while uphole end 175*a* of piston 175 faces and directly contacts drilling fluid in annulus 147. Seal assemblies 179*b* prevent fluid communication between the drilling fluid in annulus 147 and the drilling fluid flowing through passage 153. The drilling fluid in each annulus 146, 147 is in fluid communication with annulus 27 via ports 138, 139, respectively, in outer housing 130. Thus, the drilling fluid within each annulus 146, 147 is at the same pressure as the drilling fluid in annulus 27 proximal ports 138, 139, respectively. Since, at a given depth, the drilling fluid flowing down drillstring 20 has a higher pressure than the drilling fluid flowing through annulus 27, there is a pressure differential across piston 175—end 175*b* faces relatively high pressure drilling fluid (drillstring pressure) whereas end 175*a* faces relatively low pressure drilling fluid (annulus pressure).

The pressure differential across piston 175 generates an axial upward force on piston 175, which is transferred to mandrel assembly 150 (piston 175, washpipe 170, and mandrel 160 are fixably attached together end-to-end). During steady state drilling operations where changes in the pressure of drilling fluid in passage 153, annulus 27, section 146*b*, and annulus 147 are gradual (i.e., there are no pressure pulses generated by pulse generator 110), the biasing force generated by biasing member 180 acts to balance and counteract the axially upward force on piston 175 generated by the pressure differential to maintain shock tool 120 at or near its neutral position. However, under dynamic conditions, such as when pressure pulses generated by pulse generator 110 act on downhole end 175*b*, the cyclical increases and decreases in the pressure differentials across piston 175 generate abrupt increases and decreases in the axial forces applied to piston 175. The biasing member 180 generates a biasing force that resists the axial movement of piston 175, however, it takes a moment for the biasing force to increase to a degree sufficient to restore shock tool 120 and mandrel assembly 150 to the neutral position. As a result, the pressure pulses generated by pulse generator 110 axially reciprocate piston 175 (and the remainder of mandrel assembly 150 fixably coupled to piston 175) relative to outer housing 130, thereby reciprocally axially extending and contracting shock tool 120. As piston 175 moves axially relative to outer housing 130, drilling fluid is free to flow between annulus 27 and annulus 147 via ports 139 to maintain the pressure in 147 the same as the pressure in annulus 27.

Many conventional shock tools do not include a piston fixably coupled to the mandrel, and instead, the pressure pulses generated by a pressure pulse generator are transferred to the mandrel through a floating piston and the hydraulic oil in the hydraulic oil chamber. In particular, the pressure pulses generate a pressure differential across the floating piston, the floating piston moves axially in response to the pressure differential, movement of the floating piston generates a pressure wave that moves upward through the hydraulic oil in the hydraulic oil chamber and acts on an uphole portion of the mandrel to move the mandrel axially relative to the outer housing. Thus, such conventional shock tools may be described as operating by indirect actuation of the mandrel. In contrast, embodiments of shock tools described herein (e.g., shock tool 120) that operate via direct actuation of the mandrel assembly—the pressure pulses from the pulse generator (e.g., pulse generator 110) act directly on the static piston (e.g., piston 175) fixably coupled to the mandrel (e.g., mandrel 160). Without being limited by this or any particular theory, direct actuation offers the potential for improved actuation efficiency and responsiveness as compared to indirect actuation. In particular, during the transfer of the pressure pulses through the floating piston and hydraulic oil to the mandrel in indirect actuation, energy may be lost to friction, heat, etc.

In many conventional shock tools, the seals isolating the hydraulic oil chamber from drilling fluid (e.g., the seals between the outer housing and the mandrel and the seals of the floating piston) are exposed to the relatively high pressure drilling fluid flowing down the drillstring and the pressure pulses generated by the pulse generator. In addition, such seals must withstand the pressure differentials that actuate the mandrel (the pressure pulses are transferred to the mandrel via the floating piston and hydraulic oil chamber). In contrast, embodiments of shock tools described herein isolate the floating piston, the hydraulic oil chamber, and the seals defining the hydraulic oil chamber are isolated from the relatively high pressure drilling fluid flowing down the drillstring and the pressure pulses generated by the pulse generator. Specifically, in embodiments described herein, the floating piston, the hydraulic oil chamber, and the seals separating the hydraulic oil chamber from drilling fluid are pressure balanced to the annulus of the borehole. For example, in the embodiment of shock tool 120 described above, the pressure pulses do not act on floating piston 190 and associated seal assemblies 196*a*, 196*b*, and further, the pressure pulses do not act on seal assemblies 137*a*. Thus, floating piston 190, seal assemblies 196*a*, 196*b*, and seal assemblies 137*a* are not exposed to the abrupt increases and decreases in the pressure generated by pulse generator 110. Rather, floating piston 190, seal assemblies 196*a*, 196*b*, and seal assemblies 137*a* are only exposed to the relatively low pressure of drilling fluid in annulus 27 and the hydraulic oil in chamber 148, which as described above is at the same relatively low pressure as the drilling fluid in annulus 27. In this manner, static piston 175 isolates floating piston 190, seal assemblies 196*a*, 196*b*, 137*a*, and hydraulic fluid chamber 148 from the pressure pulses generated by pulse generator 110.

Figure 9:
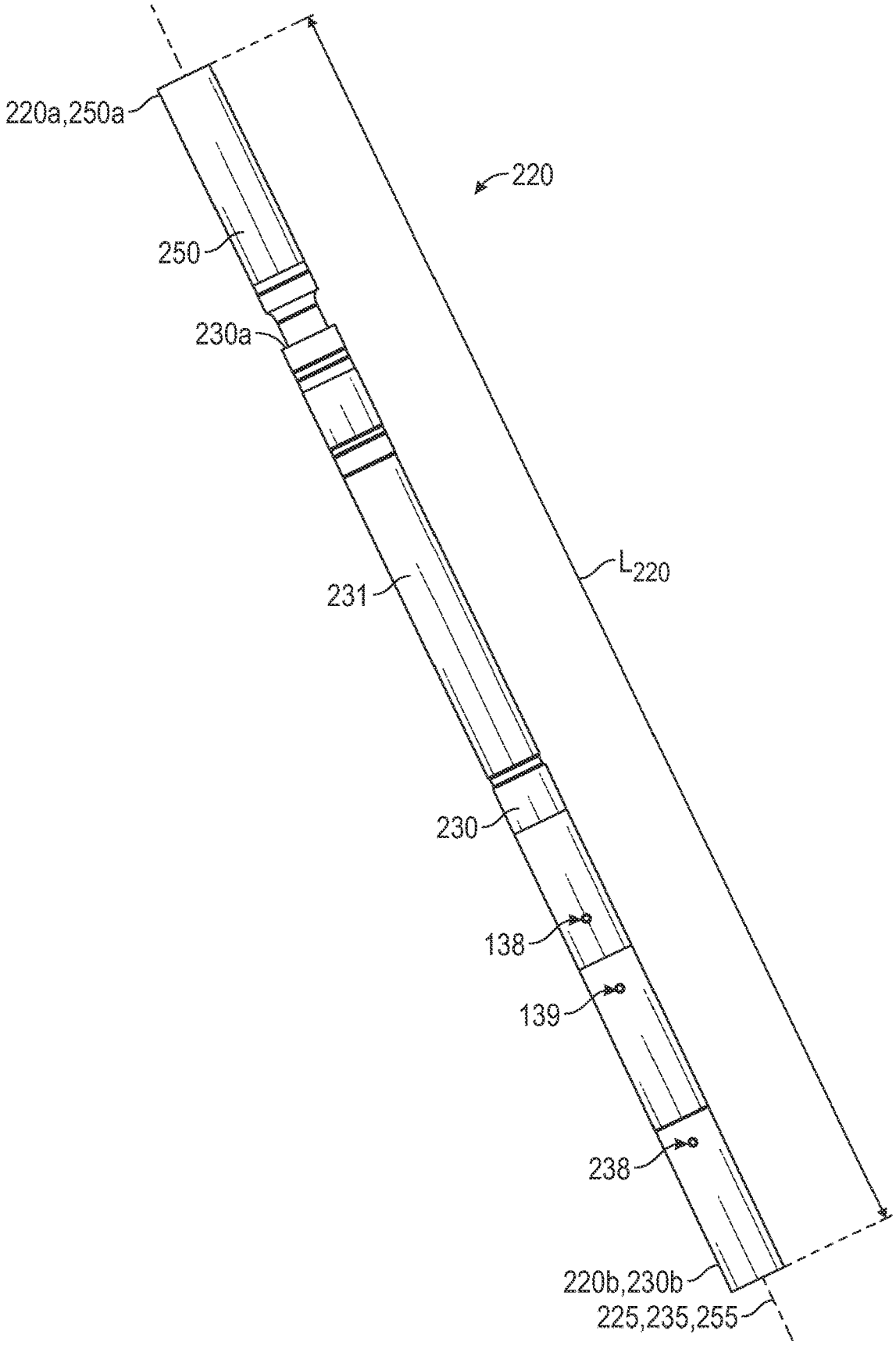
FIG. 9 is a side view of an embodiment of a shock tool.
Figure 10:
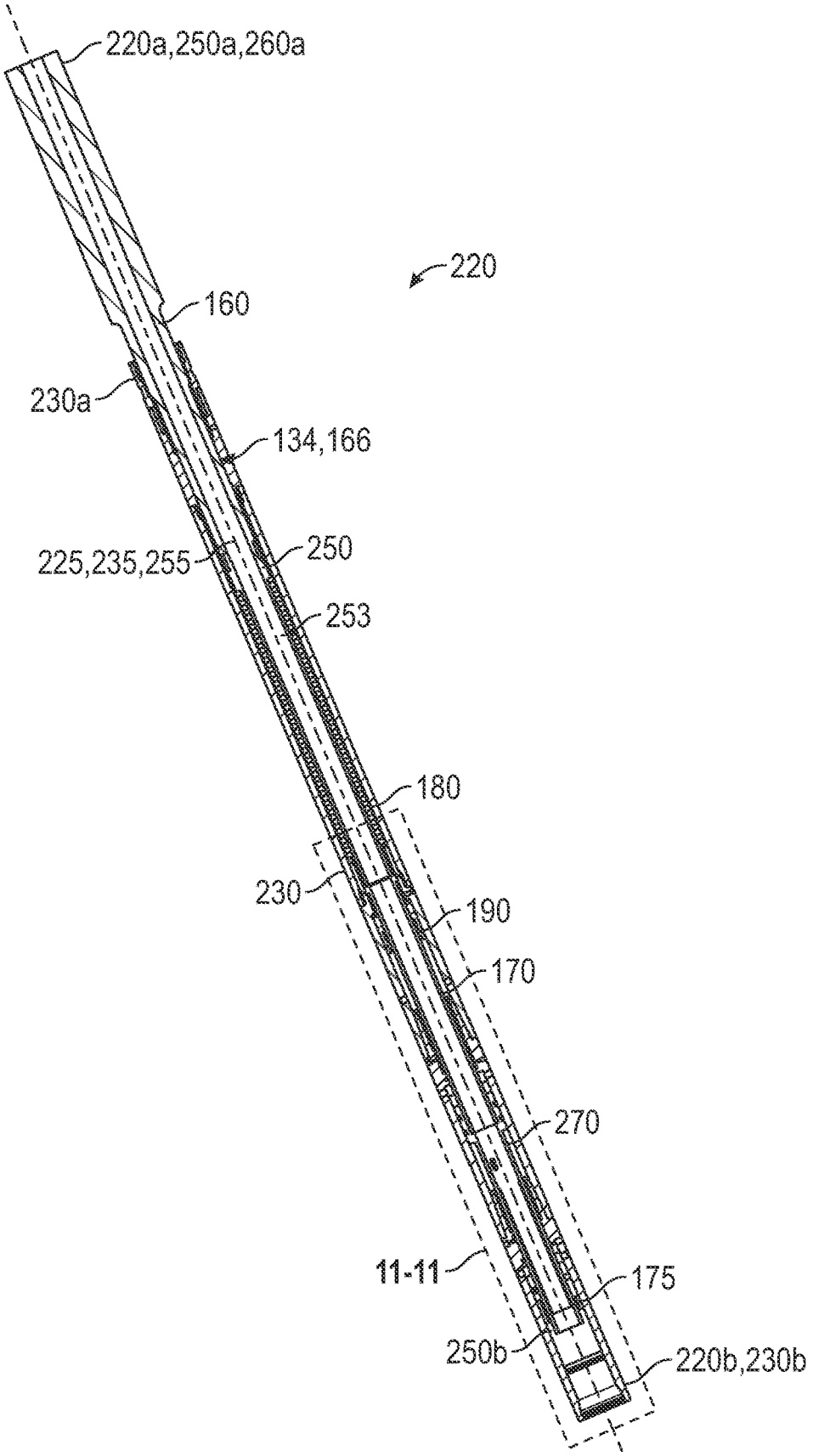
FIG. 10 is a cross-sectional side view of the shock tool of FIG. 9.

Referring now to FIGS. 9 and 10, another embodiment of a shock tool 220 is shown. Shock tool 220 can be used in oscillation system 100 in place of shock tool 120 previously described. Shock tool 220 is substantially the same as shock tool 120 with the exception that shock tool 220 includes a plurality of static pistons fixably coupled to the mandrel and directly actuated by the pressure pulses generated by pulse generator 110. This functionality offers the potential to enhance the total energy transferred to the mandrel assembly by each pressure pulse. This may be particularly beneficial in drilling operations where available drilling fluid pressure pumping capacity from rig pumping systems is limited. As will be described in more detail below, in this embodiment of tool 220, the total piston area (A) to be operated on by the drilling fluid pressure differential (P) is increased via inclusion of multiple static pistons, thereby increasing the net force (F) applied to the mandrel according to the relationship $F=P\times A$.

Shock tool 220 has a first or uphole end 220*a*, a second or downhole end 220*b* opposite end 220*a*, and a central or longitudinal axis 225. Tool 220 has a length $L_{220}$ measured axially from end 220*a* to end 220*b*. Similar to shock tool 120, shock tool 220 cyclically axially extends and retracts in response to the pressure pulses in the drilling fluid generated by pulse generator 110 during drilling operations. Thus, shock tool 220 may also be described as having an "extended" position with ends 220*a*, 220*b* axially spaced apart to the greatest extent (i.e., when length $L_{220}$ is at a maximum) and a retracted position with ends 220*a*, 220*b* axially spaced apart to the smallest extent (i.e., when length $L_{220}$ is at a minimum).

Referring still to FIGS. 9 and 10, shock tool 220 includes an outer housing 230, a mandrel assembly 250 telescopically disposed within outer housing 230, a biasing member 180 disposed about mandrel assembly 150 within outer housing 230, and an annular floating piston 190 disposed about mandrel assembly 150 within outer housing 230. Thus, biasing member 180 and floating piston 190 are radially positioned between mandrel assembly 250 and outer housing 230. Biasing member 180 and floating piston 190 are each as previously described.

Mandrel assembly 250 and outer housing 230 are tubular members, each having a central or longitudinal axis 255, 235, respectively, coaxially aligned with axis 225 of shock tool 120. Mandrel assembly 250 can move axially relative to outer housing 230 to enable the cyclical axial extension and retraction of shock tool 220. Biasing member 180 axially biases shock tool 220 to the "neutral" position between the extended position and the retracted position.

Outer housing 230 is substantially the same as outer housing 230 previously described with the exception that outer housing 230 includes an additional sub at its lower end that defines additional shoulders and cylindrical surfaces along the inner surface and an additional set of radial ports. Thus, outer housing 230 has a first or uphole end 230*a*, a second or downhole end 230*b* opposite end 230*a*, a radially outer surface 231 extending axially between ends 230*a*, 230*b*, and a radially inner surface 232 extending axially between ends 230*a*, 230*b*. Inner surface 232 defines a central throughbore or passage 233 extending axially through housing 230 (i.e., from uphole end 230*a* to downhole end 230*b*).

Figure 11:
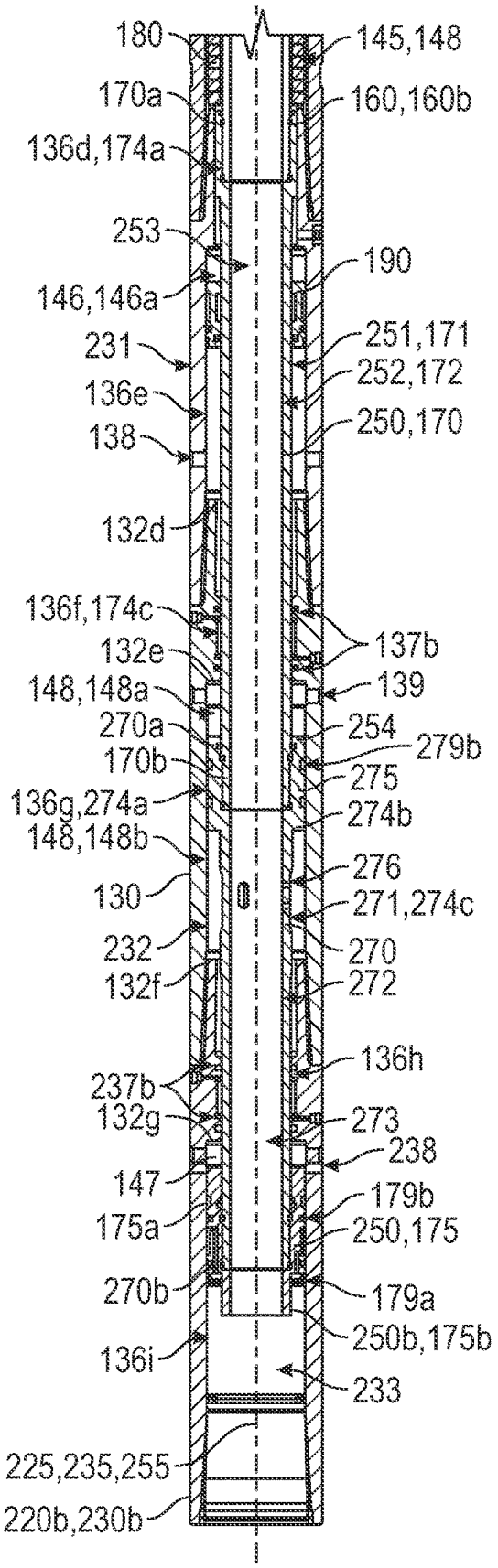
FIG. 11 is an enlarged partial cross-sectional side view of the shock tool of FIG. 9 taken in section 11-11 of FIG. 10.

Referring now to FIG. 11, an enlarged view of the lower portion of shock tool 220 is shown. It should be appreciated that the portion of shock tool 220 disposed above the lower portion shown in FIG. 11 is the same as shock tool 120 previously described. Inner surface 232 is the same as inner surface 132 previously described with the exception that inner surface 232 includes an uphole facing planar annular shoulder 132*f* disposed axially below cylindrical surface 136*g*, a downward facing planar annular shoulder 132*g* disposed axially below shoulder 132*f*, a cylindrical surface 136*h* axially positioned between shoulders 132*f*, 132*g*, and a cylindrical surface 136*i* extending axially downward from shoulder 132*g*. In addition, in this embodiment, a plurality of axially spaced annular seal assemblies 237*b* are disposed along cylindrical surface 136*h* and radially positioned between outer housing 230 and mandrel assembly 250. Seal assemblies 237*b* form annular seals between mandrel assembly 250 and outer housing 230, thereby preventing fluids from flowing axially between cylindrical surface 136*h* and mandrel assembly 250. As will be described in more detail below, seal assemblies 237*b* maintain separation of relatively low pressure drilling fluid in fluid communication with annulus 27 and relatively high pressure drilling fluid flowing down drillstring 20 and through mandrel assembly 250.

Outer housing 230 includes ports 138, 139 as previously described. However, in this embodiment, outer housing 230 also includes a third plurality of circumferentially-spaced ports 238 extending radially from outer surface 231 to inner surface 232. Ports 238 are axially positioned below ports 138, 139 and extend radially from outer surface 231 to cylindrical surface 236*i*. Ports 238 are disposed at the same axial position along outer housing 230 and are uniformly angularly spaced about axis 235. Similar to ports 138, 139, ports 238 allow fluid communication between the annulus 27 outside shock tool 220 and through passage 233 of outer housing 230.

Referring again to FIGS. 10 and 11, mandrel assembly 250 is substantially the same as mandrel assembly 150 previously described with the exception that mandrel assembly 250 includes an additional washpipe at its lower end that defines an additional static piston and includes a set of drilling fluid ports. Thus, mandrel assembly 250 has a first or uphole end 250*a*, a second or downhole end 250*b* opposite end 250*a*, a radially outer surface 251 extending axially between ends 250*a*, 250*b*, and a radially inner surface 252 extending axially between ends 250*a*, 250*b*. Inner surface 252 defines a central throughbore or passage 253 extending axially through mandrel assembly 250 (i.e., from uphole end 250*a* to downhole end 250*b*).

Mandrel assembly 250 includes a mandrel 160, a tubular member or washpipe 170 coupled to mandrel 160, and an annular static piston 175, each as previously described. However, in this embodiment, mandrel assembly 250 includes a second tubular member or washpipe 270 axially positioned between washpipe 170 and piston 175. Mandrel 160, washpipe 170, washpipe 270, and piston 175 are connected end-to-end and are coaxially aligned with axis 255.

As best shown in FIG. 11, washpipe 270 has a first or uphole end 270*a*, a second or downhole end 270*b* opposite end 270*a*, a radially outer surface 271 extending axially between ends 270*a*, 270*b*, and a radially inner surface 272 extending axially between ends 270*a*, 270*b*. Inner surface 272 is a cylindrical surface defining a central throughbore or passage 273 extending axially through washpipe 270. Inner surface 272 and passage 273 define a portion of inner surface 252 and passage 253 of mandrel assembly 250. A portion of inner surface 272 extending axially from uphole end 270*a* includes internal threads that threadably engage the mating external threads provided at downhole end 170*b* of washpipe 170, thereby fixably securing washpipes 170, 270 end-to-end. With end 170*b* of washpipe 170 threaded into uphole end 270*a* of washpipe 270, end 270*a* defines an annular uphole facing planar shoulder 254 along outer surface 251.

Referring still to FIG. 11, moving axially from uphole end 270*a*, outer surface 271 includes a cylindrical surface 274*a* extending from end 270*a*, a downhole facing planar annular shoulder 274*b*, and a cylindrical surface 274*c* extending from shoulder 274*b*. A portion of outer surface 271 at downhole end 270*b* includes external threads that threadably engage mating internal threads at uphole end 170*a* of washpipe 170. In this embodiment, washpipe 270 includes a plurality of circumferentially-spaced ports 276 extending radially from outer surface 271 to inner surface 272. In particular, ports 276 extend radially from outer surface 271 to cylindrical surface 274*c*. Ports 276 are disposed at the same axial position along washpipe 270 and are uniformly angularly spaced about axis 255.

The uphole portion of washpipe 270 has an enlarged outer radius that defines or functions as an annular static piston 275 fixably coupled to mandrel 160. Pistons 175, 275 move axially together with the remainder of mandrel assembly 250. Cylindrical surface 274*a* defining the radially outer surface of piston 275 slidingly engages cylindrical surface 136*g* of outer housing 230. A plurality of axially spaced annular seal assemblies 279*b* are disposed along cylindrical surface 274*a* and radially positioned between piston 275 and outer housing 230. Seal assemblies 279*b* form annular seals between piston 275 and outer housing 230, thereby preventing fluids from flowing axially between cylindrical surfaces 236*g*, 274*a* of outer housing 230 and piston 275, respectively. As will be described in more detail below, seal assemblies 279*b* maintain separation of relatively low pressure drilling fluid in fluid communication with annulus 27 via ports 138, 139 and relatively high pressure drilling fluid flowing down drillstring 20 and through mandrel assembly 150. Although piston 275 is integral with washpipe 270 in this embodiment, in other embodiments, the piston 275 may be a distinct and separate annular static piston that is fixably coupled to mandrel assembly 250 along washpipe 270 or uphole of washpipe 270.

Annular piston 175 is disposed about downhole end 270*b* of washpipe 270 and extends axially therefrom. In particular, piston 175 is threaded onto downhole end 270*b*, thereby fixably attaching piston 175 to downhole end 270*b*. Seal assemblies 179*b* of piston 175 form annular seals between piston 175 and outer housing 230, thereby preventing fluids from flowing axially between cylindrical surfaces 136*i*, 179*a* of outer housing 230 and piston 175, respectively. Seal assemblies 179*b* maintain separation of relatively low pressure drilling fluid in fluid communication with annulus 27 via ports 238 and relatively high pressure drilling fluid flowing down drillstring 20 and through mandrel assembly 250.

Referring still to FIG. 11, mandrel assembly 250 is disposed within outer housing 230 with mating splines 134, 166 intermeshed and uphole end 250*a* positioned above end 230*a* of housing 230. In addition, cylindrical surfaces 136*a*, 164*c* slidingly engage with annular seal assemblies 137*a* sealingly engaging surface 164*c* of mandrel 160; cylindrical surfaces 136*f*, 174*c* slidingly engage with annular seal assemblies 137*b* sealingly engaging surface 174*c* of washpipe 170; cylindrical surfaces 136*g*, 274*a* slidingly engage with annular seal assemblies 279*b* sealingly engaging surface 136*g* of outer housing 230; cylindrical surfaces 136*h*, 274*c* slidingly engage with annular seal assemblies 237*b* sealingly engaging surface 274*c* of washpipe 270; and cylindrical surfaces 136*i*, 179*a* slidingly engage with annular seal assemblies 179*b* sealingly engaging surface 136*i* of outer housing 230. As previously described, cylindrical surfaces 136*d*, 174*a* are radially adjacent one another, however, seals are not provided between surfaces 136*d*, 174*a*. Thus, although surfaces 136*d*, 174*a* may slidingly engage, fluid can flow therebetween.

Shock tool 220 includes first annulus 145 that contains biasing member 180, second annulus 146 that contains floating piston 190, and hydraulic oil chamber 148 extending between seal assemblies 137*a* proximal uphole end 230*a* and seal assemblies 196*a*, 196*b* of floating piston 190. Annuli 145, 146, biasing member 180, piston 190, and hydraulic oil chamber 148 are each as previously described. In addition, shock tool 220 includes third annulus 147 axially positioned below annulus 146. However, in this embodiment, third annulus 147 extends axially between shoulder 132*g* and piston 175 and is in fluid communication with ports 238. Still further, in this embodiment, a fourth annulus 148 is provided between outer housing 230 and mandrel assembly 250 and extends axially between shoulders 132*e*, 132*f*. Piston 275 is disposed in annulus 148 and divides annulus 148 into a first or uphole section 148*a* and a second or downhole section 148*b*. Section 148*a* extends axially from shoulder 132*e* to piston 275 and section 148*b* extends axially from shoulder 132*f* to piston 275. Ports 139 extend to section 148*a*, thereby placing section 148*a* in fluid communication with annulus 27 and the relatively low pressure drilling fluid flowing therethrough. Section 148*b* is in fluid communication with ports 276 in washpipe 270, thereby placing section 148*b* in fluid communication with passage 253 and the relatively high pressure drilling fluid flowing therethrough. In this embodiment, section 148*b* is isolated from the relatively low pressure drilling fluid in annulus 27, section 148*a*, and annulus 147 via seal assemblies 279*b*, 237*b*.

Referring now to FIGS. 10 and 11, shock tool 220 operates in a similar manner as shock tool 120 previously described with the exception that shock tool 220 includes two static pistons 175, 275 fixably coupled to mandrel 160, each piston 175, 275 being directly actuated by pressure pulses generated by the pulse generator (e.g., pulse generator 110). In particular, downhole end 175*b* of piston 175 faces and directly contacts the relatively high pressure drilling fluid flowing through passage 253, while uphole end 175*a* of piston 175 faces and directly contacts the relatively low pressure drilling fluid in annulus 147. In addition, shoulder 274*b* defining the downhole end of piston 275 faces and directly contacts the relatively high pressure drilling fluid flowing through passage 253 via ports 276 in washpipe 270, while shoulder 254 defining the uphole end of piston 275 faces and directly contacts the relatively low pressure drilling fluid in section 148*a*. Thus, there is a pressure differential across both pistons 175, 275 fixably coupled to mandrel 160. The pressure differentials across piston 175, 275 generate axial upward forces on pistons 175, 275, which is transferred to mandrel assembly 250 (pistons 175, 275, washpipes 170, 270, and mandrel 160 are fixably attached together end-to-end). During steady state drilling operations where changes in the pressure of drilling fluid in passage 253, annulus 27, section 146*b*, section 148*a*, and annulus 147 are gradual (i.e., there are no pressure pulses generated by pulse generator 110), the biasing force generated by biasing member 180 acts to balance and counteract the axially upward forces on pistons 175, 275 to maintain shock tool 220 at or near its neutral position. However, under dynamic conditions, such as when pressure pulses generated by pulse generator (e.g., pulse generator 110) act on piston 175 and piston 275 (via ports 276 and section 148*b* of annulus 148), the cyclical increases and decreases in the pressure differentials across pistons 175, 275 generate abrupt increases and decreases in the axial forces applied to pistons 175, 275. The biasing member 180 generates a biasing force that resists the axial movement of pistons 175, 275, however, it takes a moment for the biasing force to increase to a degree sufficient to restore shock tool 220 and mandrel assembly 250 to the neutral position. As a result, the pressure pulses generated by the pulse generator axially reciprocate pistons 175, 275 (and the remainder of mandrel assembly 250 fixably coupled to pistons 175, 275) relative to outer housing 230, thereby reciprocally axially extending and contracting shock tool 220. As pistons 175, 275 move axially relative to outer housing 230, drilling fluid is free to flow between annulus 27 and annulus 147 via ports 238, drilling fluid is free to flow between annulus 27 and section 148, and drilling fluid is free to flow between passage 253 and section 148*b* via ports 276.

Embodiments of shock tool 220 offer many of the same potential advantages as shock tool 120 previously described. For example, shock tool 220 is operated via direct actuation of the mandrel assembly 250—the pressure pulses from the pulse generator (e.g., pulse generator 110) act directly on static pistons 175, 275 fixably coupled to mandrel 160. Such direct actuation offers the potential for improved actuation efficiency and responsiveness as compared to indirect actuation (i.e., actuation through a floating piston and hydraulic oil). As another example, in shock tool 220, floating piston 190, hydraulic oil chamber 148, and seal assemblies 137*a*, 196*a*, 196*b* defining the hydraulic oil chamber 148 are isolated from the relatively high pressure drilling fluid flowing down the drillstring and the pressure pulses generated by the pulse generator. Specifically, floating piston 190, the hydraulic oil chamber 148, and seal assemblies 137*a*, 196*a*, 196*b* defining the hydraulic oil chamber 148 are pressure balanced to the annulus 27 of the borehole 26. Thus, floating piston 190, seal assemblies 137*a*, 196*a*, 196*b*, and hydraulic oil chamber 148 are not exposed to the abrupt increases and decreases in the pressure generated by the pulse generator.

It should also be appreciated that embodiments described herein that include two static pistons that are directly actuated by pressure pulses (e.g., shock tool 220) offer the potential for additional benefits. In particular, such embodiments enhance the net axial force applied to the mandrel assembly (e.g., mandrel assembly 250) as the pressure differentials resulting from differences in the pressure of the drilling fluid pumped down the drillstring, the pressure of drilling fluid in the borehole annulus, and the pressure pulses are applied to both pistons, effectively multiplying the total axial force applied to the mandrel assembly. This may be particularly beneficial when axial reciprocation of the shock tool and drillstring are desired, but the pressure differential is insufficient to actuate a single piston. Although the embodiment of shock tool 120 shown in FIGS. 2 and 3 includes on static piston 175 disposed along mandrel assembly 150, and the embodiment of shock tool 220 shown in FIGS. 9 and 10 includes two static pistons 175, 275 disposed along the mandrel assembly 250, in general, any suitable number of static pistons (e.g., static pistons 175, 275) may be disposed along the mandrel assembly (e.g., mandrel assembly 150, 250) to achieve the desired axial force applied to the mandrel assembly by pressure pulses generated by a pulse generator (e.g., pulse generator 110). For example, in some embodiments, three, four, or more static pistons may be provided along the mandrel assembly to enhance the net axial force applied to the mandrel assembly.

As previously described, in many conventional shock tools, pressure pulses generate a pressure differential across a floating piston. The pressure differential acts over the surface area of the piston exposed to the pressure differential to generate a net axial force on the piston. The floating piston moves axially in response to the axial force, the axial movement of the floating piston generates a pressure wave that moves upward through hydraulic oil in a hydraulic oil chamber and acts on an uphole portion of the mandrel to move the mandrel axially relative to the outer housing, thereby inducing the reciprocal axial extension and contraction of the shock tool. The amplitude of the axial reciprocation of the shock tool is a function of the axial force applied to floating piston—the greater the axial force applied to the piston, the greater the amplitude of the axial reciprocation of the shock tool. As noted above, the axial force applied to the floating piston is a function of the pressure differential across the floating piston and the surface areas of the piston exposed to the pressure differential. Thus, the axial force applied to the floating piston, and hence the amplitude of the reciprocal axial extension and contraction of the shock tool, can be increased by increasing the pressure differential across the floating piston and/or increasing the surface areas of the floating piston exposed to the pressure differential.

Increasing the pressure of the drilling fluid pumped from the surface down the drillstring and through the pulse generator can increase the amplitude of the pressure pulses generated by the pulse generator. Unfortunately, this may not be possible due to upper limits in the drilling fluid pumping capacity of the rig at the surface. Increasing the diameter of the floating piston can increase the surface areas of the floating piston acted on by the pressure differential. Unfortunately, this may not be possible as diameter of the borehole limits the maximum diameter of the shock tool, which in turn limits the maximum diameter of the floating piston.

In scenarios where there is no ability to increase the pressure of the drilling fluid being pumped down the drillstring through the pulse generator and no ability to increase the diameter of the shock tool (to increase the diameter of the floating piston), it may not be possible to enhance or increase the amplitude of the reciprocal axial extension and contraction of the shock tool. However, embodiments described herein offer the potential to increase the amplitude of the reciprocal axial extension and contraction of a shock tool without increasing the pressure of the drilling fluid being pumped down the drillstring and without increasing the diameter of the shock tool. More specifically, by adding static pistons that are directly actuated by pressure pulses (e.g., moving from shock tool 120 to shock tool 220), the net axial force applied to the mandrel (e.g., mandrel 160) at a given pressure differential across the pistons is increased.

Figure 12:
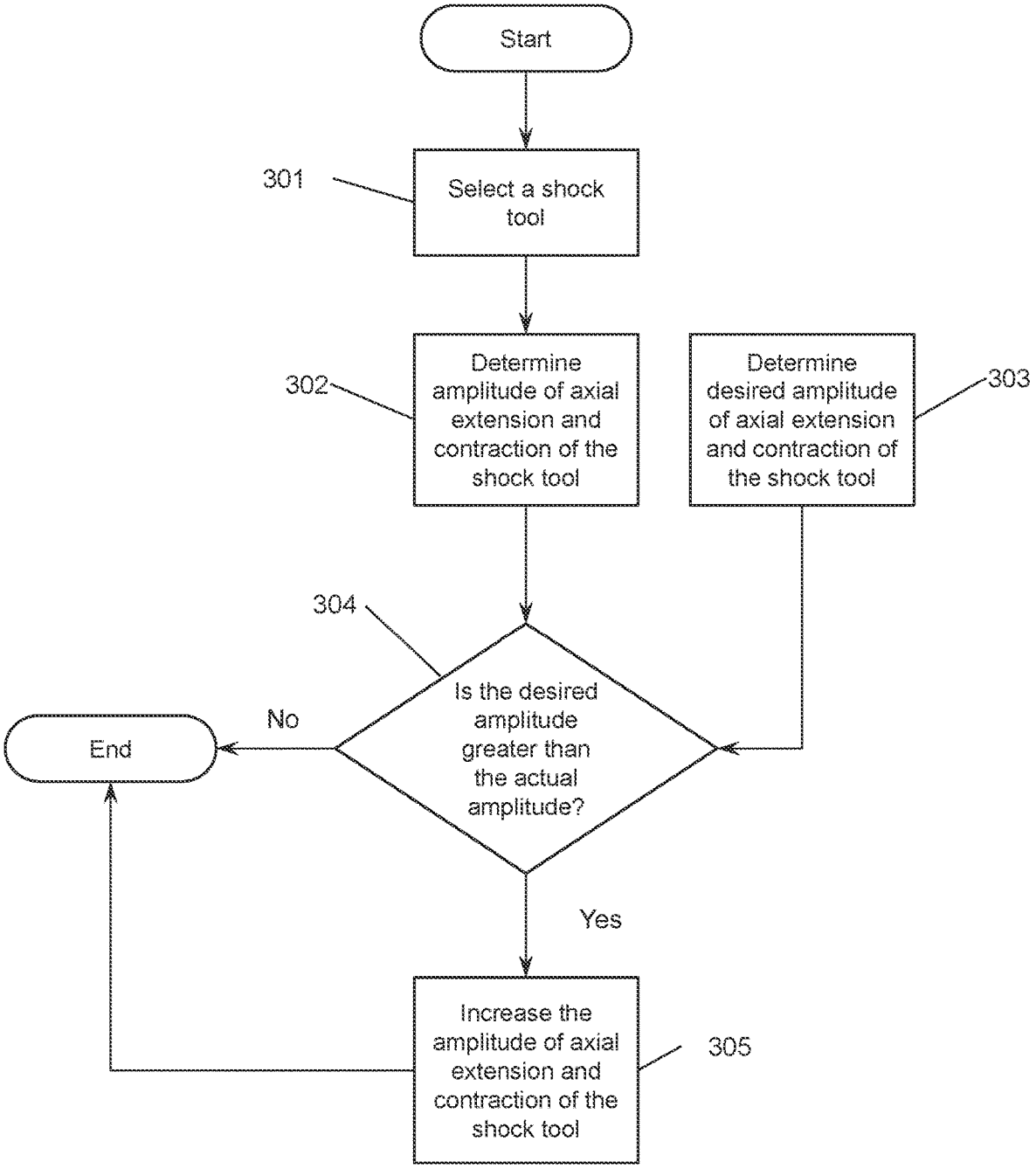
FIG. 12 is a flowchart illustrating an embodiment of a method for increasing the reciprocal axial extension and contraction of a shock tool in accordance with principles described herein.

Referring now to FIG. 12, an embodiment of a method 300 for increasing the amplitude of the reciprocal axial extension and contraction of a shock tool is shown. In this embodiment, the amplitude of the reciprocal axial extension and contraction of the shock tool is increased by increasing the axial force applied to a mandrel of a shock tool by providing one or more additional annular static pistons fixably coupled to the mandrel assembly of the shock tool. Thus, in this embodiment, the amplitude of the reciprocal axial extension and contraction of the shock tool is increased without increasing the diameter of the shock tool and without the need to increase the pressure of drilling fluid being pumped down the drillstring.

Beginning in block 301, a shock tool is selected. Selection of the shock tool may depend on a variety of factors including, without limitation, the drilling conditions and parameters such as the capacity of the mud pumps, the pressure and flow rate of drilling mud during drilling operations, the size (e.g., diameter of the borehole), the pressure pulses generated by a pulse generator (e.g., pulse generator 110) disposed along the drill string, and the geometry of the borehole. For example, the diameter of the borehole may dictate the maximum outer diameter of the shock tool. It should be appreciated that the drilling conditions and parameters can be actual conditions and parameters if drilling operations have already begun or anticipated drilling conditions and parameters if drilling operations have not yet begun or are temporarily ceased.

In embodiments described herein, the shock tool selected in block 301 is similar to shock tool 120 previously described. In particular, the selected shock tool includes has a central axis and ends that define the length L of the shock tool. In addition, the shock tool includes an outer housing (e.g., outer housing 130), a mandrel assembly telescopically disposed within the outer housing (e.g., mandrel assembly 150), a biasing member (e.g., biasing member 180) disposed about the mandrel assembly within the outer housing, and annular floating piston (e.g., floating piston 190) disposed about the mandrel assembly within the outer housing 130. In addition, the mandrel assembly includes a mandrel (e.g., mandrel 160) and a first annular static piston (e.g., piston 175) fixably coupled to the mandrel (e.g., with washpipe 170). Due to the axial movement of the mandrel assembly relative to the outer housing during cyclical axial extension and retraction of the shock tool, the length L of the shock tool varies between a maximum with its ends axially spaced apart to the greatest extent and a minimum with its ends axially spaced apart to the smallest extent.

Moving now to block 302, an amplitude of reciprocal axial extensions and contractions of the selected shock tool at a given pressure differential is determined. The given pressure differential is the actual or anticipated pressure differential acting across the first static piston of the shock tool during the generation of pressure pulses by a pulse generator (e.g., pulse generator 110). For clarity and further explanation, the amplitude of reciprocal axial extensions and contractions of the selected shock tool at the given pressure differential determined in block 302 may also be referred to herein as the "actual" amplitude. In embodiments described herein, the pressure differential is the difference between the fluid pressure of a pressure pulse within the mandrel assembly and the fluid pressure outside the housing (based on actual drilling conditions or anticipated drilling conditions). The given pressure differential defines the pressure differential acting across the first static piston of the shock tool, which results in the application of an axial force to the first static piston and the mandrel assembly as previously described. In general, the actual amplitude is equal to the difference between the maximum length of the shock tool and the minimum length of the shock tool at the given pressure differential and can be calculated using techniques known in the art.

Depending on the drilling conditions and parameters (actual or anticipated), it may be desirable to increase the actual amplitude at the given pressure differential (e.g., in response to the pressure pulses generated by pulse generator 110). For example, in drilling a lateral section of a borehole, it may be desirable to increase the actual amplitude to reduce friction between the drillstring and the borehole sidewall. Thus, in block 303, a desired amplitude of reciprocal axial extensions and contractions of the selected shock tool is determined. For purposes of clarity and further explanation, the desired amplitude of reciprocal axial extensions and contractions of the selected shock tool determined in block 303 may also be referred to herein as the "desired" amplitude. Then, in block 304, the desired amplitude from block 303 is compared to the actual amplitude from block 302. If the desired amplitude is less than the actual amplitude, then it is not necessary to increase the amplitude of reciprocal axial extensions and contractions of the selected shock tool. However, if the desired amplitude is greater than the actual amplitude, then the amplitude of reciprocal axial extensions and contractions of the selected shock tool is increased in block 305. In embodiments described herein, the amplitude of reciprocal axial extensions and contractions of the selected shock tool is increased in block 305 by lengthening the selected shock tool, and more specifically, by fixably coupling one or more additional annular static pistons to the mandrel assembly as previously described with respect to shock tool 220 (as compared to shock tool 120). More specifically, the first annular static piston (e.g., piston 175) and each additional annular static piston (e.g., piston 275) coupled to the mandrel assembly experiences substantially the same pressure differential—the pressure differential between the fluid pressure of pressure pulses generated by the pulse generator within the mandrel assembly and the pressure of drilling fluid flowing along the outside of the outer housing, thereby enhancing the net axial force applied to the mandrel assembly.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method for increasing an amplitude of reciprocal axial extensions and contractions of a shock tool configured to induce axial oscillations in a drillstring during drilling operations, the method comprising:

(a) selecting the shock tool, wherein the shock tool has a central axis and an axial length, wherein the shock tool includes an outer housing, a mandrel telescopically disposed within the outer housing, and a first annular piston fixably coupled to the mandrel, and wherein the shock tool has a first amplitude of reciprocal axial extension and contraction at a pressure differential between a first fluid pressure in the outer housing and a second fluid pressure outside the outer housing:

(b) fixably coupling a second annular piston to the mandrel of the shock tool and increasing the axial length of the shock tool after (a), wherein the second annular piston is axially spaced from the first annular piston, wherein the shock tool has a second amplitude of reciprocal axial extension and contraction at the pressure differential between the first fluid pressure in the outer housing and the second fluid pressure outside the outer housing after (b), wherein the second amplitude of reciprocal axial extension and contraction is greater than the first amplitude of reciprocal axial extension and contraction, wherein a floating annular piston is disposed about the mandrel within the outer housing, wherein the floating annular piston is axially positioned uphole of the first annular piston and the second annular piston, wherein the floating annular piston is configured to move axially relative to the mandrel and the outer housing, and wherein the floating annular piston sealingly engages the mandrel and the outer housing.

2. The method of claim 1, further comprising:

(c) fixably coupling a third annular piston to the mandrel assembly of the shock tool after (b) and further increasing the axial length of the shock tool, wherein the third annular piston is axially spaced from the first annular piston and the second annular piston, wherein the shock tool has a third amplitude of reciprocal axial extension and contraction at the pressure differential between the first fluid pressure in the outer housing and the second fluid pressure outside the outer housing after (c), wherein the third amplitude of reciprocal axial extension and contraction is greater than the first amplitude of reciprocal axial extension and contraction and greater than the second amplitude of reciprocal axial extension and contraction.

3. The method of claim 2, wherein the outer housing has a first end, a second end opposite the first end of the outer housing, and a passage extending axially from the first end of the outer housing to the second end of the outer housing;

wherein the mandrel is coaxially disposed in the passage of the outer housing and configured to move axially relative to the outer housing, wherein the mandrel has a first end axially spaced from the outer housing, a second end disposed in the outer housing, and a passage extending axially from the first end of the mandrel to the second end of the mandrel;

wherein the first annular piston extends radially outward from the mandrel to outer housing and sealingly engages the outer housing;

wherein the second annular piston extends radially outward from the mandrel to outer housing and sealingly engages the outer housing;

wherein the third annular piston extends radially outward from the mandrel to outer housing and sealingly engages the outer housing.

4. The method of claim 1, wherein the outer housing has a first end, a second end opposite the first end of the outer housing, and a passage extending axially from the first end of the outer housing to the second end of the outer housing;

wherein the mandrel is coaxially disposed in the passage of the outer housing and configured to move axially relative to the outer housing, wherein the mandrel has a first end axially spaced from the outer housing, a second end disposed in the outer housing, and a passage extending axially from the first end of the mandrel to the second end of the mandrel;

wherein the first annular piston extends radially outward from the mandrel to outer housing and sealingly engages the outer housing;

wherein the second annular piston extends radially outward from the mandrel to outer housing and sealingly engages the outer housing.

5. The method of claim 1, further comprising:

providing fluid communication between a first annulus extending axially from an uphole end of the first annular piston and an environment outside the outer housing, wherein the first annulus is radially positioned between the mandrel and the outer housing, wherein the first annular piston is fixably attached to a downhole end of the mandrel; and providing fluid communication between a second annulus extending axially from an uphole end of the second annular piston and the environment outside the outer housing, wherein the second annulus is radially positioned between the mandrel and the outer housing, wherein the second annular piston is axially positioned uphole of the first annular piston.

6. The method of claim 5, further comprising:

providing fluid communication between a passage extending axially through the mandrel and a downhole end of the first annular piston; and providing fluid communication between the passage in the mandrel and a downhole end of the second annular piston.

7. The method of claim 1, further comprising positioning a biasing member about the mandrel in an annulus radially positioned between the mandrel and the outer housing to resist axial movement of the mandrel relative to the outer housing.

8. The method of claim 1, wherein a hydraulic oil chamber is radially positioned between the mandrel and the outer housing, wherein the hydraulic oil chamber extends axially from an uphole end of the floating piston.

9. The method of claim 8, further comprising:

providing fluid communication between an annulus extending axially from a downhole end of the floating piston and the environment outside the outer housing, wherein the annulus is radially positioned between the mandrel and the outer housing.

* * * * *